US011774105B2

(12) United States Patent
Chase et al.

(10) Patent No.: US 11,774,105 B2
(45) Date of Patent: Oct. 3, 2023

(54) INTELLIGENT MICROWAVE COOKING SYSTEM

(71) Applicants: Arnold Chase, West Hartford, CT (US); William Chase, Avon, CT (US)

(72) Inventors: Arnold Chase, West Hartford, CT (US); William Chase, Avon, CT (US)

( * ) Notice: Subject to any disclaimer, the term of this patent is extended or adjusted under 35 U.S.C. 154(b) by 0 days.

(21) Appl. No.: 17/868,313

(22) Filed: Jul. 19, 2022

(65) Prior Publication Data

US 2023/0024004 A1 Jan. 26, 2023

Related U.S. Application Data

(60) Provisional application No. 63/223,683, filed on Jul. 20, 2021.

(51) Int. Cl.

| | |
|---|---|
| ***H05B 6/64*** | (2006.01) |
| ***H05B 6/72*** | (2006.01) |
| ***F24C 7/02*** | (2006.01) |
| ***F24C 7/08*** | (2006.01) |

(52) U.S. Cl.

CPC ..... *F24C 7/02* (2013.01); *F24C 7/087* (2013.01); *H05B 6/645* (2013.01)

(58) Field of Classification Search

CPC ... H05B 6/645; H05B 6/12; F24C 7/02; F24C 7/087

USPC ..... 219/707, 704, 705, 703, 710, 711, 716, 219/746, 748, 757, 400, 492, 494; 426/524, 241, 515, 565; 374/21, 149, 374/124

See application file for complete search history.

(56) References Cited

U.S. PATENT DOCUMENTS

| | | | | |
|---|---|---|---|---|
| 6,630,655 | B2 * | 10/2003 | Fukunaga | H05B 6/6455 374/149 |
| 8,124,920 | B1 * | 2/2012 | Weber | H05B 6/6411 219/754 |
| 2007/0299562 | A1 * | 12/2007 | Kates | H02J 3/14 700/295 |
| 2010/0213187 | A1 | 8/2010 | Bandholz et al. | |
| 2013/0306627 | A1 | 11/2013 | Libman et al. | |
| 2015/0289324 | A1 | 10/2015 | Rober et al. | |
| 2016/0316524 | A1 | 10/2016 | Franchi et al. | |

FOREIGN PATENT DOCUMENTS

| | | | | |
|---|---|---|---|---|
| CH | 712395 | A2 * | 10/2017 | F24C 7/088 |

OTHER PUBLICATIONS

International Search Report and Written Opinion for International Appl. No. PCT/US22/37598; International Filing Date: Jul. 19, 2022; dated Dec. 14, 2022; 13 pages.

* cited by examiner

*Primary Examiner* — Quang T Van
(74) *Attorney, Agent, or Firm* — CANTOR COLBURN LLP

(57) ABSTRACT

Aspects include a system that allows a microwave oven to intelligently self-choose the optimal cooking time for various items to prevent over/under cooking as well as overcoming cooking inconsistencies that are inherent in non-intelligent microwave ovens. Cooking time optimizations can be performed by controlling radio-frequency emission, cooking time, and/or rotation or movement of a turntable or platter within a microwave cavity of a microwave oven to more evenly heat the contents therein.

20 Claims, 15 Drawing Sheets

INTELLIGENT MICROWAVE COOKING SYSTEM

CROSS-REFERENCE TO RELATED APPLICATIONS

This application claims the benefit of U.S. Provisional Application No. 63/223,683 filed Jul. 20, 2021, the disclosure of which is incorporated herein by reference in its entirety.

BACKGROUND

The subject matter disclosed herein generally relates to cooking systems and, more particularly, to an intelligent microwave cooking system.

Over the last 60 years, microwave ovens, both in commercial as well as residential use, have become ubiquitous, yet the underlying control technology has essentially remained unchanged by still requiring a user to manually enter a cooking time. This results in users of microwave ovens guessing as to cooking time and power settings best suited to items being heated within microwave ovens.

BRIEF DESCRIPTION

Disclosed is a microwave cooking system configured to monitor one or more power characteristics and adjust one or more operational parameters during system operation.

Embodiments can include systems, methods, and computer program products.

According to an aspect, a system includes a microwave energy source, a microwave oven cavity, an actuation system configured to move a platter within the microwave oven cavity, and a controller. The controller is configured to self-determine one or more parameters of a target object to be heated in the microwave oven cavity, perform a baseline analysis of the target object based on the one or more parameters to self-determine a heating plan for the target object, control the actuation system to alter a position and rate of motion of the platter based on the heating plan and one or more observed conditions while the microwave energy source is energized, and self-determine when the heating of the target object is complete.

According to an aspect, a method includes determining one or more parameters of a target object to be heated in a microwave oven cavity, and performing a baseline analysis of the target object based on the one or more parameters to self-determine a heating plan for the target object. The method also includes controlling an actuation system to physically alter a position and rate of motion of a platter in the microwave oven cavity based on the heating plan and one or more observed conditions while a microwave energy source is energized, and determining that heating of the target object is complete.

According to an aspect, a method includes determining, by a controller, whether automated stirring has been selected for a target object to be heated in a microwave oven cavity of a microwave cooking system and determining, by the controller, a stirring profile for the target object based on determining that automated stirring has been selected. A microwave energy source of the microwave cooking system is energized until a first heating stage has completed. An actuation system of the microwave cooking system is controlled to alter a position and rate of motion of the target object based on the stirring profile while the microwave energy source is de-energized. The microwave energy source can subsequently be energized based on determining that a second heating stage is scheduled to be performed.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
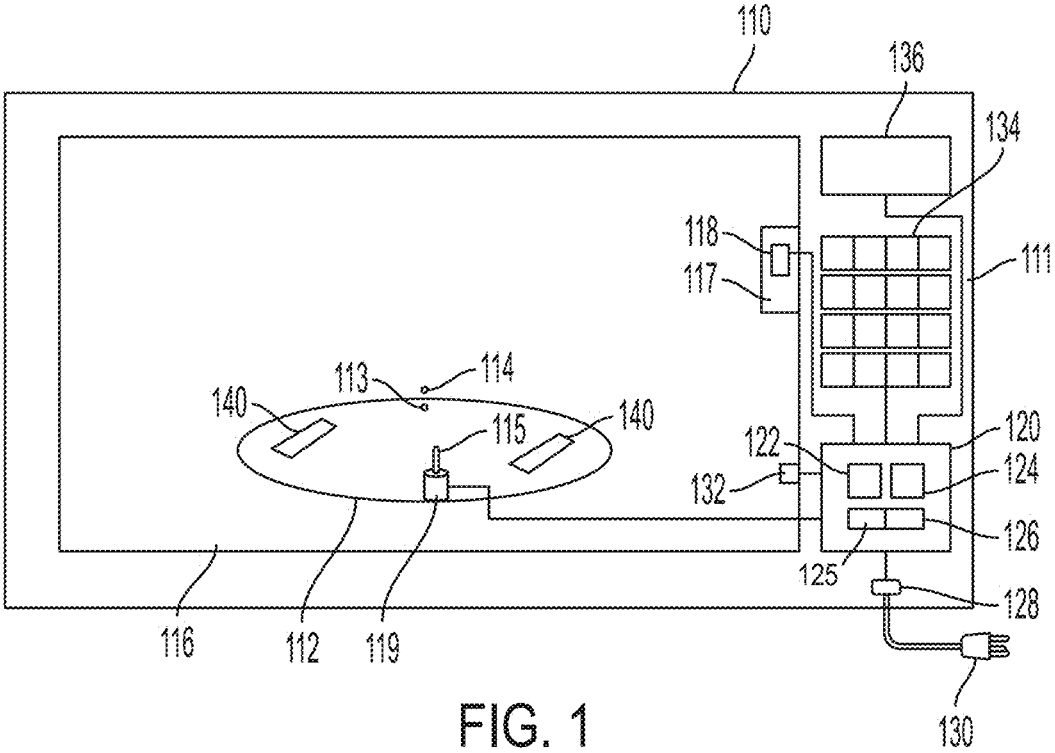
FIG. 1 depicts an exemplary schematic layout of an Intelligent Microwave Cooking System (IMCS) according to some embodiments of the present invention.

A detailed description of one or more embodiments of the disclosed apparatus and method are presented herein by way of exemplification and not limitation with reference to the Figures.

Embodiments of the present invention include an Intelligent Microwave Cooking System (IMCS) that largely overcome one of the most problematic aspects of microwave oven operation, that being an inability to satisfactorily and consistently control the cooking of a plethora of food items. Non-microwave ovens cook items much more slowly, and because of this inherent length of time needed to cook items, such ovens can take advantage of inherent heat migration within a cooked item itself. This allows an enhanced measure of thermal uniformity within conventionally cooked items. Because the cooking time of microwave ovens is often measured in seconds, a high percentage of items cooked with this method end up being undercooked, overcooked, or unevenly cooked. Furthermore, microwave cooked items are often required to sit for several minutes [i.e., post-cooking] and/or required to be stirred before consumption to allow at least some measure of heat migration to occur within a cooked item, albeit at the cost of wasted time and a reduction in the overall temperature of items post-cooking. This difference is especially evident in frozen items, where part of the food may still remain near freezing, while other parts of the food are overcooked beyond the point of enjoyable consumption.

Microwave ovens cook food by using radio-frequency (RF) energy, which excites and vibrates water molecules within the food, and which in turn creates heat to cook the item. Due to the technical limitations of the RF energy which is typically produced by (but not limited to) a magnetron in a microwave oven, the actual RF output power level of a magnetron needs to remain at a fixed (e.g., 100%) output level (or within a small subset of that) at all times of magnetron operation. While almost every microwave oven contains a "Power Level" control(s), these controls merely alter the "duty cycle", or percentage of on/off operating time of the magnetron's full RF production. Typically, when a microwave oven is set for "full" power, this setting results in a continuous (uninterrupted) production of the RF energy produced by the magnetron. Lower "power" settings merely cause an alternating operation of the magnetron between being in fully 'on' and fully 'off' states, with the percentage of the "off" time increasing as the "power" level is reduced. In this manner, the lower the desired power level selected, the less average power output occurs during a selected time period, which is recognized as a lower "duty cycle".

Regardless of the "power" level setting selected by a user, the selection of both the overall cooking time as well as the selection of a "Power Level" is, at best, merely a guess by the user. An individual typically does not know the precise weight of an item being cooked, the percentage of water or ice the item contains, the precise temperature of the item either before cooking or after, the actual output power rating/wattage of the oven, or other relevant information which is needed to properly/optimally cook an item. Furthermore, it is unlikely that a user of the microwave oven would be able to determine the translation of energy to create desired heat in the foods. Even with cooking instructions/recommended cooking times that may be printed on food packaging there typically may be a series of additional independent manually effectuated steps to try to properly cook the packaged item. Variances in microwave manufacturer models and even minor variations of the food item location within the microwave cavity can alter the cooking outcome.

Instead of a user manually selecting a duration(s) that the oven is supposed to cook for, and what preset power level (duty cycle percentage) to use over the entire selected cooking segment, in exemplary embodiments, the IMCS lets the cooked item(s) themselves dynamically interact with and directly instruct the oven as to determine how long to cook an item, as well as dynamically interact with and instruct the oven as to dynamically decide at which power level(s) (duty cycle) to utilize at any given time, for instance, by monitoring in real time the energy that is actually being accepted and absorbed by a cooked item. This design not only allows for the oven itself to automatically decide when to shut off the cooking process before an item becomes overcooked, but additionally, an IMCS can automatically extend the typical cooking time of an item being cooked if the monitored item(s) has not been deemed by the oven to be sufficiently cooked. Furthermore, if an item being cooked or heated has region area inconsistencies in its detected absorption of [cooking] energy (which would result in some areas of an item being undercooked while other areas of the item might be overcooked), the IMCS can dynamically control multiple aspects, such as the power output, cooking time, and energy delivered to specific parts of an item while it is cooking. For example, the IMCS can simultaneously reduce or increase the amount of cooking energy delivered for just those parts of an item that have already been determined to have absorbed different/inconsistent amounts of cooking energy relative to the other parts of the item, thus bringing a unique intelligence level and cooking consistency to microwave ovens.

Microwave cooking devices share inherent common limitations caused by the physical properties of the generated and delivered microwave energy itself. More specifically, microwaves or any radio frequency waves for that matter, have specific physical resonant wavelength properties associated with each frequency that is generated. Since the microwave energy that is produced by a microwave oven is fed into what is essentially a microwave cavity, this inherently sets up non-uniform wave patterns inside the cavity, or "microwave oven", which are caused by reflections, phase interferences, cancellations, etc. which results in the production of hot spots, "null" energy areas, etc. Further, the type of magnetron that is typically used with a microwave oven is not a "precision" device, e.g., it is not able to hold a set or specific output frequency that is typical of "precision" devices, such as radar, etc. Due to this inherent instability of the output frequencies produced, it is almost impossible to physically "tailor" a microwave oven cavity to be optimized for a particular output frequency and its inherent physical properties. The net result of this manifests itself through the all too typical lack of energy uniformity delivery that is associated with microwave cooking.

Without energy uniformity within an oven cavity, the ability to evenly heat or cook even foods of a homogeneous nature is fundamentally challenged. In an effort to mitigate this absence of energy dispersal evenness within a microwave cavity, various adaptations have been developed over the years such as the addition of RF paddle stirrers, rotating food turntables, etc. in an effort to try and even out the inconsistencies of energy within the oven cavity. While these adaptations have only marginally helped to increase the energy uniformity within a cavity, the goal of consistently achieving uniform levels of cooking is still intrinsically thwarted by the inconsistent makeup and composition of the food itself. This can result in different rates of energy being absorbed among the different parts of the food item(s) being heated. It is all too typical to have, after cooking, parts of a food item that are very warm while other parts of that same item are still in a frozen or cool state.

As pointed out earlier, the microwave oven's RF energy vibrates water molecules, which results in heat being generated within the food itself. As such, even if a perfectly consistent energy distribution were able to be created within a microwave cavity, there would still be a lack of cooking/heating uniformity because of the very composition of the food itself. When a lack of energy uniformity within a microwave oven is then combined with the inherent lack of food uniformity, it may be apparent why microwave ovens have typically not consistently produced ideal results.

In embodiments of the invention, the IMCS differs from prior microwave cooking approaches in numerous aspects. First, rather than requiring an operator to manually set a desired cooking time(s) prior to the start of cooking or heating, the IMCS can directly and dynamically monitor and control the timing and actual amount of energy that is delivered to, and absorbed by, areas of food or other microwaved items itself during the cooking process. A user may specify energy saturation of foods (e.g., heating) instead of making an approximation of time by using the IMCS features of measuring the energy absorbed by the food.

Although prior microwave cooking approaches have attempted to offer various "automatic" heating, defrosting, reheating, or other so-called "smart" cooking options, these designs lack the capability to directly monitor the cooking or heating process to determine optimal cooking times. Such approaches merely monitor overall secondary or resultant conditions, such as sensing the overall temperature of an item or sensing the amount of steam that is being produced by an item being cooked or heated. These "indirect" proxy sensing methods further require an operator to manually (and with accuracy) indicate the size and/or weight of an item being cooked in order to generalize, for instance, the correlation between the level of steam produced and the completeness of an item being cooked or defrosted. Further, such "indirect" methods do not provide any capability or control for ensuring any uniformity of cooking or heating within an item, thus resulting in portions of the item(s) that are being cooked or heated to be over or under cooked and lacking in cooking or heating uniformity. These attempts do not try to address the direct problem of microwave cooking, which is that the heating of water molecules is limited to those that directly intersect the Radio Frequency wave in the microwave cavity. The steam/temperature measurements measure the resulting heat or steam from the intersected molecules but not those that are not intersected.

In contrast, the IMCS can provide for a continual dynamic monitoring that results in an actual targeted assignment of different energy levels delivered in the course of a cooking/heating session, thus providing substantial uniformity of cooking or heating an item. Furthermore, the IMCS does not have the limitations of so-called "automatic" cooking, which typically requires an item to be frozen or needing to possess a high-water content.

A "typical" microwave oven is often equipped with either a fixed rotational speed turntable or a laterally moving platter, which constantly moves whatever is placed upon it during cooking in an effort to mechanically attempt to compensate for the varying location of energy transmission and the resultant energy absorption. Non-intelligent microwave ovens have no intelligent correlation between positional adjustment of an item being cooked or heated and the areas within a cavity that are experiencing non-typical power levels. Such continuous "random" turntable rotation or platter movement is an attempt to blindly average the microwave oven's energy delivery to a cooked item while still lacking the ability to target specific area(s) of an item. While theoretically a simple turntable rotation or platter shift should improve the uniformity of the absorbed energy, the energy shifting location in a typical microwave oven is still essentially random in nature, which still results in the typically overcooked/undercooked parts of items that have been cooked or heated. Essentially, such approaches attempt to achieve uniform heating by stacking enough randomness to try and make it uniform.

Virtually every pre-packaged food item that is designed to be cooked by a microwave oven usually features a cooking disclaimer on its packaging such as, "Cooking times may vary with different oven power levels", etc. This disclaimer is necessary because different package and portion sizes, the physical makeup of each item, the number of simultaneously cooked items that are present during a cooking session, the pre-cooked ambient temperature of the item(s), position on the platter within the microwave and the microwave model itself can all affect and vary the optimal cooking time for that session. As such, it is virtually impossible for a person to "on the fly" to correctly manually calculate for, compensate for, and determine a proper cooking time for every microwave cooking session in order to avoid over/under cooking items.

For the purposes of this disclosure, a "cycle" comprises one complete physical rotation and "scan" of the entire targeted object being heated or cooked. The physical process of completing a "cycle" by the IMCS may take several forms: First, a circular platter may be rotated through a 360° excursion around a central axis. Alternately, a rectangular platter may complete a preset "side to side" linear or oval shaped excursion motion within the oven cavity. These and other such embodiments are designed to ensure that at least all of the surface area of an object being heated or cooked has been scanned with an attendant recording of the power delivered (e.g., as a dielectric loss) representative of each part of the surface area within the object being scanned.

Embodiments that utilize a rotary turntable can be equipped with a servo motor, a position encoder, an "end of rotation" position index or some other similar device marking to serve as a reference to track the completion of a rotational cycle. The center of the rotary platter is meant to be lined up with the approximate center of the item to be heated or cooked. The use of this positioning indicator in conjunction with compartmental packaging of, for instance, an entrée and a side dish, can further allow the IMCS logic to separately analyze individual sector areas. The terms "sector" and "section" are used interchangeably herein. Similarly, a platter may also be equipped with a lateral position indicating line to indicate a front to back centering target position.

Turning now to the drawings, FIG. 1 depicts an exemplary schematic layout of an IMCS 110 (also referred to as system 110) according to some embodiments of the present invention. FIG. 1 represents an exemplary schematic layout of the IMCS 110, including operating controls 111 that provide a user interface. Microwave energy enters the microwave oven cavity 116 of the IMCS 110 through a waveguide opening 117 as generated by a microwave energy source 118, such as a magnetron. A platter 112, such as a rotational platter with a center rotational point 115, can be configured to support a target object, such as food or a beverage, within the microwave oven cavity 116. The platter 112 can be equipped with a positional "home" or "start" positional indicator 113, which signals a positional sensor 114 when the platter 112 is located at the "home" position to indicate to the processing system that a rotational cycle has been completed. An actuation system 119, such as a motor, can be controlled to alter a position and rate of motion of the platter 112.

A controller 120 of the IMCS 110 can include a processing system with at least one processing circuit 122, a memory system 124, an input/output interface 125, and power conditioning circuitry 126. The processing circuit 122 can be any type of processor, microcontroller, or programmable logic device known in the art. The memory system 124 can include volatile and non-volatile memory to store executable instructions and/or data used in operating and controlling the IMCS 110 through IMCS logic (e.g., control law instructions and data). The input/output interface can receive inputs, such as user input (e.g., through operating controls 111) and sensor input (e.g., power/current sensors, position sensors, temperature sensors, door sensors, and the like). The input/output interface 125 can drive outputs, such as a magnetron, motor, lights, fans, displays, and the like. The input/output interface 125 can also receive user inputs through a user interface 134 (e.g., a keypad) of the operating controls 111 and generate output on a user display 136 of the operating controls 111. The power conditioning circuitry 126 can convert input power for various uses within the IMCS 110. In some embodiments, the IMCS may include a communication interface to establish communication with one or more other systems or devices. The IMCS 110 can also include one or more sensors in addition to the positional sensor 114, such as an energy sensor 128 operable to monitor input power 130, a temperature sensor 132, and other such sensors. The energy sensor 128 can be a current sensor or other type of sensor from which energy use (e.g., input power to the magnetron) can be determined, as well as a RF output (delivered RF energy) level sensor. The energy sensor 128 can be located at a sensing position that is electrically downstream of other electrical components, such as fans and motors, and is proximate to the magnetron input to detect magnetron current draw.

In embodiments, the IMCS 110 can be equipped with either rotary turntables or laterally shifting platters as the platter 112. Within the IMCS 110, the motion of the turntables or platters can be intelligently and dynamically positioned and controlled and operated so as to advance beyond the simple random continuous movement functionality. IMCS turntables and platters differ from "conventional" turntables and platters in numerous ways: First, the rotational or lateral movement speed of the turntable or platter may continuously and dynamically varied during a cooking session. Second, IMCS turntables and platters can be capable of operating in a dynamic bi-directional manner. Within the bi-directional operation, the physical turntable or platter movement may range from a simple "back and forth" (e.g. clockwise/counterclockwise) alternating directional movement that is centered around a small angular arc, or movement may also operate in a larger angular back and forth "slice" or sector scan of the overall turntable rotation or platter area. Within a single cooking cycle, the turntable or platter rotation or movement can be dynamically controlled by IMCS logic, and may operate just in a unidirectional manner (e.g., with varying rotational or movement speed within a single overall rotation or movement cycle), or the platter 112 may operate with a combination of several different movement patterns within each rotational or movement cycle. Portions of a single rotational or movement cycle may also utilize a combination of sectors with continuous single speed turntable rotation or platter movements, multiple independent sectors instructed for different turntable rotation speeds or platter movement speeds, independent sectional "back and forth" rotation or movement speeds within a single overall movement cycle. Further, the turntable or platter may be commanded by the IMCS logic for a time to completely halt rotation or movement in order to allow additional concentrated energy to be delivered to a specific spot or area. An objective of specifically varying just specific sections of the turntable or platter movement within a single cycle is to allow the IMCS logic the ability to sense and mitigate specific asymmetric "target" areas of thermal/energy absorption inconsistencies within any item(s) being cooked by dynamically altering the microwave energy being presented to substantially every area of the target object. Depending on a particular food type, "traditional" modified duty-cycle operation(s) may be desirable when combined with IMCS operational elements to extend the amount of time that water is present in liquid form in low-water content items to create better thermal absorption profiles. Additionally, embodiments that are equipped with inverter power supplies that are capable of limited actual RF power reduction may also be integrated into the IMCS logic and control system.

The IMCS 110 can perform dynamic monitoring and analysis, for example, via two different pathways: 1) monitoring of the total/overall RF or primary input power delivered for each completed sweep by the IMCS logic for the purpose of comparing it to the previous sweep(s) so as to determine the state of cooking/heating completeness in order for it to control whether the IMCS logic should continue the cooking/heating process or whether to end the process; and/or 2) determining the instant actual RF power level being delivered to and accepted by each area/sector/portion of an item being cooked or heated.

In embodiments, the IMCS can use the motion of a turntable or platter in order to dynamically "learn" the power acceptance characteristics from each area/sector/portion of the target object within each cycle, thus creating a positional 'map' of that sweep for the IMCS logic by matching each physical location against the amount of energy having been previously delivered and absorbed by the item being cooked by defining accepted energy levels with a specific angular position of the platter rotation or the lateral position of a platter. Essentially this recording of the previous rotational or movement scan(s) creates a so-called "heat map", where the height of the heat map's "Intensity" axis represents the cumulative and/or previous amount of energy that has already been delivered to any given section of a turntable or platter. The data in the heat map can be used by the IMCS logic to subsequently equalize the amount of energy that is further absorbed by the target food item in a given location which would inherently lead to a superior thermal uniformity immediately after a cooking session was complete, without the need to wait for heat migration within the cooked item to take place.

The platter 112 with modified operational parameters, such as faster and/or stronger movements, while there is no energy being delivered to the cavity may also serve to allow items on the surface area to experience higher "G" forces and/or "jerky" start/stop and or modified circular movements (eccentric) which would cause sauces, etc. in a package to laterally spread and mix with more solid components that are being cooked or heated. The platter 112 can include one or more gripping members 140, such as clips, flexible straps, a higher friction area, or other gripping or holding implements used in the case of food containers or prepackaged frozen foods, to secure such packaging to a fixed location of the platter 112. The automated stirring would advantageously eliminate the need to manually interrupt the cooking process to remove an item mid-cycle, peel the covering, stir or mix the contents being cooked, and replace the covering and return the item back to the platter 112 in order to further achieve a superior uniformity within the cooking process. Automated stirring can be performed according to a stirring profile for a target object, where the controller 120 drives the actuation system 119 to control movement of the platter 112 based on the stirring profile, for instance, while the microwave energy source 118 is de-energized.

The platter 112 can be any type of turntable, rectangular platter, or other such moveable component having a surface upon which a target object can be placed and movement controlled. Thus, references to "turntables", "platters", or other such items that can provide a moveable surface for controlled heating and/or stirring of target objects are generally referred to as "platters" herein. Further, the platter 112 can have any suitable shape, such as circular, rectangular, or other such geometries.

Figure 2:
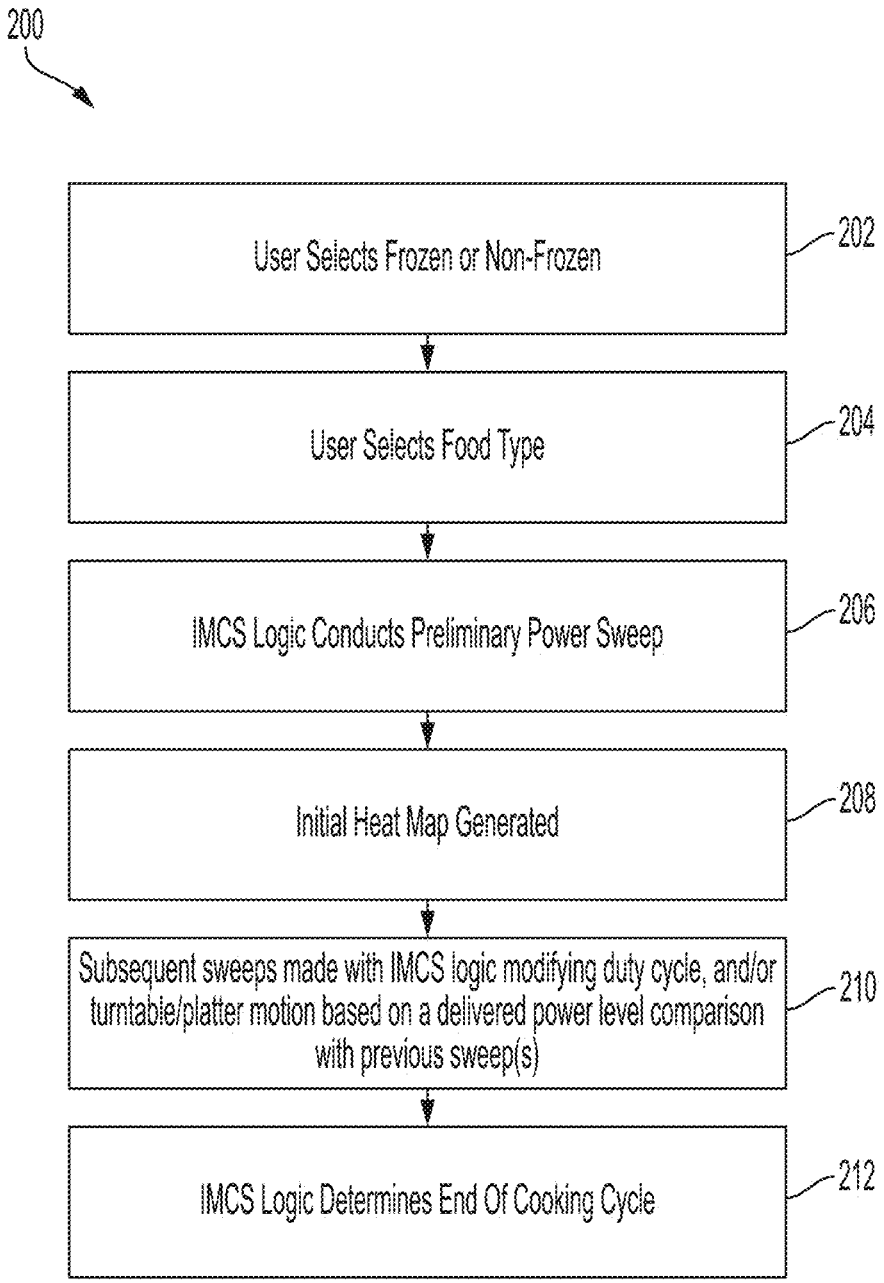
FIG. 2 depicts a cooking process for an IMCS according to some embodiments of the present invention.

FIG. 2 depicts a cooking process 200 for an IMCS according to some embodiments of the present invention. The cooking process 200 can be implemented using the IMCS 110 of FIG. 1. At block 202, a user can select whether a target object, such as food in a container on the platter 112 of FIG. 1 is frozen or non-frozen. At block 204, a user can select a food type. The food type can assist in distinguishing between foods that are likely to have a higher water or salt content that may impact the cooking process. Selections can be made through the user inputs received at the user interface 134.

At block 206, IMCS logic executed by the controller 120 can conduct a preliminary power sweep. The preliminary power sweep may control the actuation system 119 to position the platter 112 such that the positional indicator 113 initially aligns with the positional sensor 114, and the platter 112 is cycled in position for a full rotation or side-to-side motion. The controller 120 can energize the microwave energy source 118 and control the actuation system 119 to move the platter 112 through a full cycle while observing an energy parameter associated with the microwave energy source 118. For example, where the platter 112 is a round platter, the platter 112 can be rotated 360 degrees while monitoring the energy sensor 128 to determine power utilization at various segments of the rotation. Where the platter 112 is a laterally shifting platter, the platter 112 can be moved to maximum-most position in one direction followed by a maximum-most position in an opposite direction (e.g., right-most then left-most) to re-establish a home position.

At block 208, an initial version of a heat map can be generated based on the data collected at block 206. At block 210, the controller 120 can make subsequent sweeps (i.e., cycles of motion) of the platter 112 with the IMCS logic modifying a duty cycle and/or motion of the turntable/platter of platter 112 based on a delivered power level comparison with previous sweeps. The heat map can be updated as further cycles of sweeps are performed and changes in the energy parameter are observed. At block 212, the IMCS logic can determine an end of the cooking/heating session. The end can be based on an observed reduction in the total averaged power delivered during a complete movement sweep of the platter 112 or reaching a predetermined uniformity of power delivered over all of the sweeps (e.g. a reduction in the section/sector delivered power excursions) during a complete sweep cycle rather than stopping after a fixed amount of time.

Figure 3:
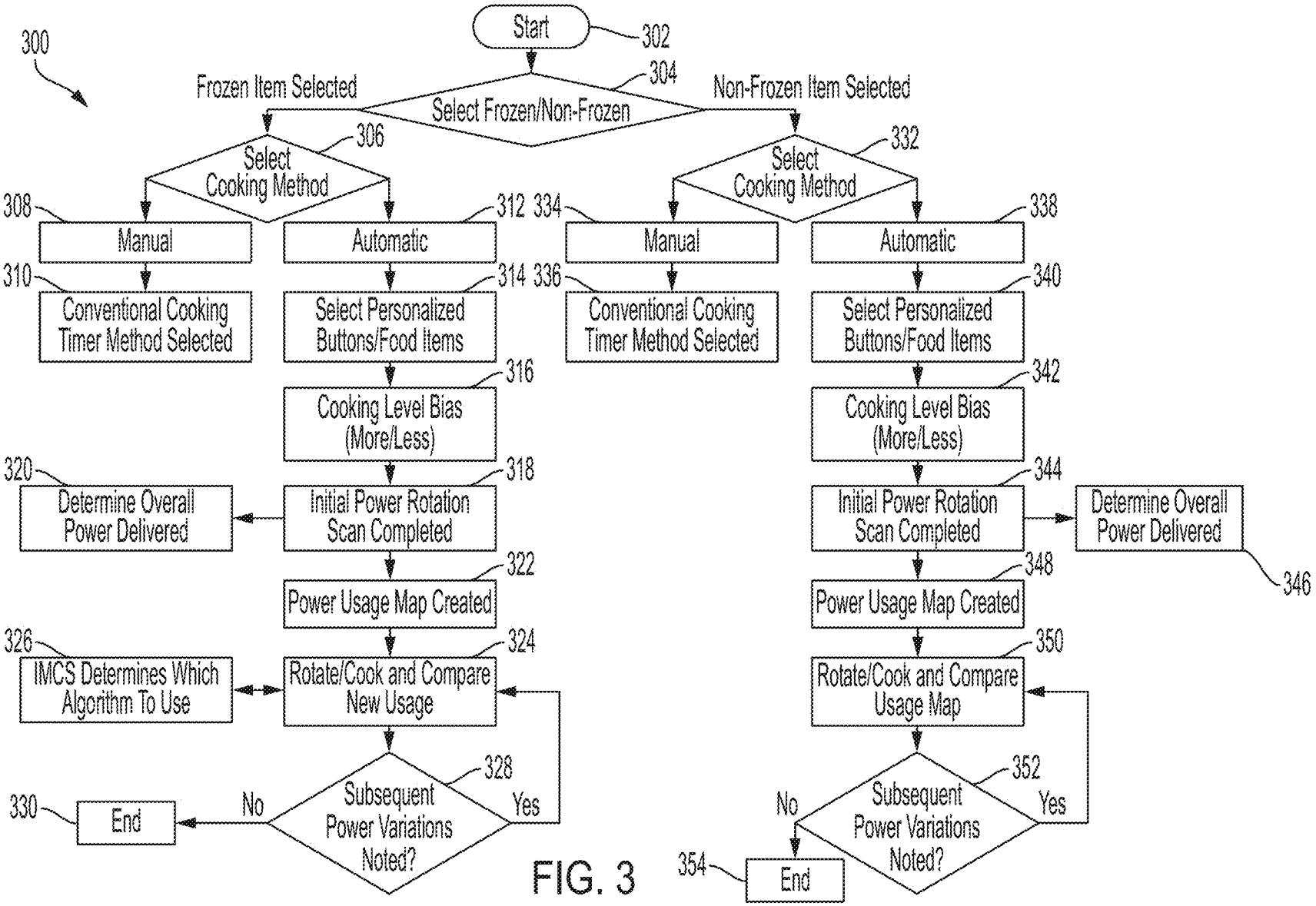
FIG. 3 depicts another example of a cooking process for an IMCS according to some embodiments of the present invention.

FIG. 3 depicts another example of a cooking process 300 for an IMCS according to some embodiments of the present invention. The process 300 can be performed using the IMCS 110 of FIG. 1. At block 302, the process 300 starts and continues to block 304. At block 304, a selection between a frozen and non-frozen state is determined. Based on a frozen item being selected at block 304, a selection is performed at block 306 between cooking methods.

Based on a manual cooking selection at block 308, a conventional cooking timer method of cooking can be selected for controlling the IMCS 110 of FIG. 1 at block 310. Based on an automatic cooking method selection at block 312, further personalization selections can be made at block 314, which may further identify a food item type. At block 316, a cooking level bias can be input, for instance, to heat a food item to a preferred hotter or cooler final temperature. Said bias selection may be altered on an item to item basis, or may be retained in memory to suit overall individual preferences. At block 318, an initial power scan can be completed to rotate or shift the food item through at least one full cycle (e.g., a rotation) and determine an overall power delivered at block 320. The results of the initial scan can also be used to create a power usage map at block 322. At block 324, the IMCS 110 can continue to rotate/cook the food item and compare a new level of power usage to determine where temperature differences likely exist. At block 326, the controller 120 of the IMCS 110 can determine which algorithm to use to monitor and adjust heating at targeted locations. For example, frozen foods may need to be warmed slower to evenly defrost the food before cooking. At block 328, the IMCS logic can continue to monitor for subsequent scan power variations as heating continues. When subsequent scan power variations exist beyond a threshold level, the process 300 returns to block 324. When subsequent scan power variations do not exist beyond the threshold level, the process 300 ends at block 330.

Returning to block 304, based on a non-frozen item being selected at block 304, a selection is performed at block 332 between cooking methods. Based on a manual cooking selection at block 334, a conventional fixed cooking timer method of cooking can be selected for controlling the IMCS 110 of FIG. 1 at block 336. Based on an automatic cooking method selection at block 338, further personalization selections can be made at block 340 which may further identify a food type. At block 342, a cooking level bias can be input, for instance, to heat a food item(s) to a preferred hotter or cooler final temperature. Bias selection may be altered on an item to item basis, or may be retained in memory to suit overall individual preferences. At block 344, an initial power scan can be completed to rotate or shift the food item through at least one full cycle (e.g., a rotation) and determine an overall power delivered at block 346. The results of the initial scan can also be used to create a power usage map at block 348. At block 350, the IMCS 110 can continue to rotate/cook the food item and compare a new level of power usage to determine where temperature differences likely exist. At block 352, the IMCS logic can continue to monitor for subsequent overall power variations as heating continues. When subsequent overall power variations exist beyond a threshold level, the process 300 returns to block 352. When subsequent power variations do not exist beyond the threshold level, the process 300 ends at block 354.

In embodiments, the platter or turntable of an IMCS 110 can use a particular point or location as a "starting" reference (e.g., positional indicator 113) so the IMCS logic can precisely link any given sector area of the platter or turntable with the historic and/or present power absorption level. As an example, a turntable can keep track of a "starting" rotational position by the use of a magnet affixed to the turntable that is configured to activate a magnetic switch, the use of a Hall Effect sensor, the use of an optical position encoder of the platter drive shaft, a stepper motor with a known number of steps per a 360° rotation, or any other positional tracking device known in the art to establish a starting point for use by the IMCS logic. By knowing the starting point of, for instance, a platter, the IMCS logic is able to dynamically determine the position of the platter at any point in a rotational cycle.

A turntable's positional data may have a positional resolution capability that allows a high accuracy resolution so that 360 or more sector positional sampling data points can be generated within a single complete rotation of the turntable. With various other embodiments, for example, the actual positional accuracy of a single rotation may instead represent the energy absorption data for one of 36, 10-degree samples. Similarly, it should be noted that the degree resolution of lateral movement of a platter may vary from a single angular degree of motion resolution per defined segment to multiple degrees per defined segment. Regardless of the granularity of resolution, each defined segment sample can be combined with other segments to create an overall heat map which can provide the IMCS logic with a correlation between a defined physical segment location and the historic energy absorption from that defined segment.

The IMCS logic can, for instance, at all times during a cooking cycle [subsequent to the creation of an initial heat map] compare the present power delivered at each sectional location with the previous scan(s) from which the power data can be constantly compared, analyzed and acted upon by the IMCS logic. As an example, if "section #12" on the previous scan had accepted far more power than other nearby sections, then in a following sweep, the IMCS logic can further increase the average power delivered to that section via, for instance, an increased "linger time" created by a rotational slowdown over just that section, the utilization of a back and forth "rocking motion centered on that section, etc. Conversely, if a section(s) in the previous scan showed a less than average power acceptance relative to other sections, the IMCS logic can reduce the average delivered power available to that section by a decreased "linger time" caused by a rotational speed up over that section.

By the IMCS logic comparing both the total power accepted in all of the sectors in a sweep, the IMCS logic is able to determine an overall target average energy acceptance for that sweep, as well as noting any change in power absorption between subsequent scans from the same defined sector(s), at least two things are able to be accomplished. First, by dynamically comparing the power absorption differences between a given sector and the adjacent sector or sectors, the magnitude of the difference between these sectors [if large enough] would allow the IMCS logic to make sector-specific power corrections, increasing, decreasing, momentarily stopping the power output, or continuing the previous scan's delivered power level for each specifically defined sector in subsequent rotations until the delta (i.e., difference) of each target sector and the adjacent defined sectors is reduced below a pre-determined delta difference level. This would result in a homogenous temperature profile occurring in a cooked item. At a predetermined point of overall reduced power readings for a complete scan, a second operating mode is entered in which the summed total of all of the sectors for a given sweep can be compared to completed previous scans in an effort to recognize an overall newly reduced power acceptance level of an item that may be indicative of a fully cooked item which would then terminate the cooking session.

Since microwave energy that is introduced into the oven cavity is primarily accepted by and absorbed by ice and/or other states of water, the amount and rate of overall energy acceptance is a good proxy indicator as to the amount of remaining moisture in an oven's contents. If the IMCS logic senses an overall reduction in total energy absorption beyond a certain overall threshold level, then that is an indication to the IMCS logic that the item being cooked has started to dry out and if the cooking/heating is not terminated it would become overcooked. At such a condition, the IMCS logic would terminate the cooking cycle before overcooking occurs.

Conversely, if the IMCS logic has not yet detected any diminishment in the overall energy acceptance rate, then that it is a good proxy indication that the cooking cycle is not yet complete, and the cooking cycle may be automatically dynamically extended. By sequentially continuing this 'compare, analyze and extend' protocol until an overall downward change in the energy absorption is finally noted, this prevents the undercooking or incomplete defrosting of a target item. Some embodiments may also utilize a "fail-safe" timer which would terminate a cooking session regardless of the lack of change in power accepted after a pre-set time period of operation had expired, as well as optionally including an adjustable number of rotational cycles to continue without a change in power delivered. Those sectors that show repeated "zero" energy absorption such as would be consistent with an empty part of a plate are automatically classified as "non-target" areas which would be excluded from the dynamic energy equalization process, but that section would still be included in an overall sweep energy accepted assessment.

In order to accommodate personal cooking/heating level preferences, the overall threshold of delivered energy reduction level (which would terminate the cooking session) can be adjustable or able to be skewed operationally similar to the "lighter/darker" personal preference adjustment capability of a toaster. Note that this is not the same as adjusting the desired cooking time on a conventional microwave oven as on a non-IMCS there is no direct correlation between cooking time and degree of an item being cooked to a desired level. The IMCS 110 is capable of automatically determining the optimum cooking time based on an overall completeness, as well as an overall uniformity basis.

The energy delivered/absorption level monitoring that is fundamental to the IMCS 110 may be accomplished by monitoring either the instant primary (mains) electrical consumption (less ancillary power drawn by motors, etc.) or the electrical input power (e.g., watts) that is consumed by the magnetron (or other RF producing element) of the IMCS 110, or by a direct measurement of the RF output power being accepted by the (cooking) load in the oven cavity. Depending on the embodiment, the power monitoring may be peak power, average power, or a combination of the two.

Figure 4:
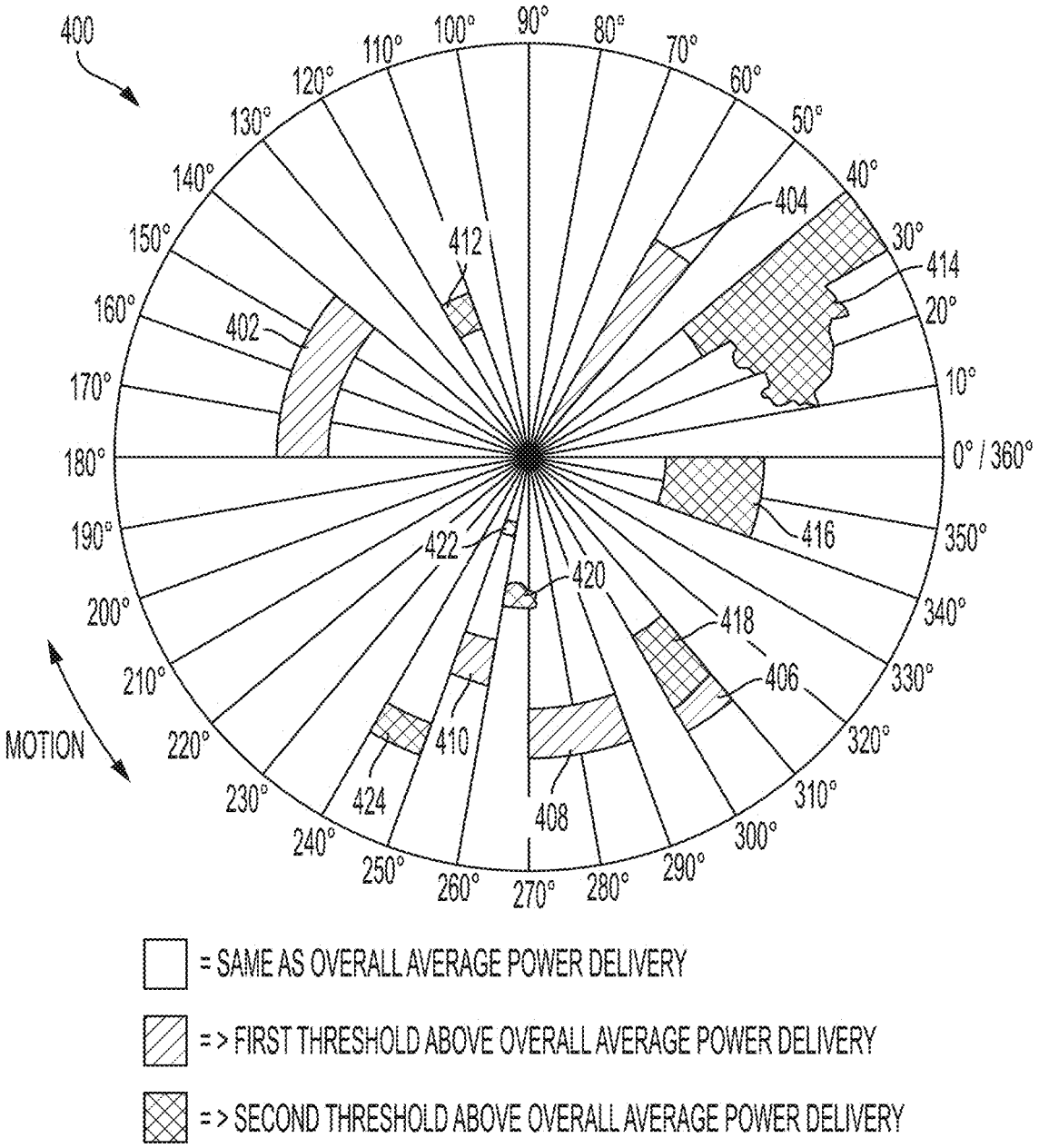
FIG. 4 depicts an exemplary heat map of an IMCS cooking session using a rotary turntable according to some embodiments of the present invention.

FIG. 4 depicts an exemplary heat map 400 of an IMCS cooking session using a rotary turntable according to some embodiments of the present invention. In the example of FIG. 4, the heat map 400 can be determined by IMCS logic of the controller 120 of FIG. 1 as the platter 112 of FIG. 1 rotates with a food item upon it. In various segments of the heat map 400, one or more sensors of the IMCS 110 can be used to determine an overall power delivery across various segments. Some segments of the heat map 400 can substantially align with the overall average power delivery, while other segments may exceed a first threshold above the overall average power delivery or exceed a second threshold above the overall average power delivery, where the second threshold is greater than the first threshold. As one example, the first threshold can be above 40% and the second threshold can be above 70%. Segments that include different levels of overall average power delivery can be grouped together depending on the features of the target item being heated. Further, some segments may include multiple variations in average power delivery which derive a segment averaged power that is accepted.

For example, a region 402 that is above the first threshold can span segments between 140 and 180 degrees, and a region 404 that is above the first threshold can span an area of a segment between 50 to 60 degrees that extends outward from a central axis of rotation. As a further example, a region 406 that is above the first threshold can be located in a segment between 300 to 310 degrees, while a region 408 that is above the first threshold can be located in segments between 270 to 290 degrees. A region 410 that is above the first threshold can be located in a segment between 250 to 260 degrees. The various regions 402-410 can have different radial positions and total areas.

The heat map 400 can also include multiple regions above the second threshold, where some of the regions above the second threshold may be in close physical proximity to regions above the first threshold. For example, a region 412 above the second threshold can be located in a segment between 110 to 120 degrees, a region 414 above the second threshold can be located in a segment between 10 to 40 degrees, a region 416 above the second threshold can be located in a segment between 340 to 360 degrees, a region 418 above the second threshold can be located in a segment between 300 to 310 degrees, a region 420 above the second threshold can be located in a segment between 260 to 270 degrees, a region 422 above the second threshold can be located in a segment between 250 to 260 degrees, and a region 424 above the second threshold can be located in a segment between 240 to 250 degrees. Although several regions, such as regions 420, 422, and 424 may be in an angular proximity, the regions 420-424 are not combined due to radial differences. Further, the regions 406, 418 and 410, 422 can exist in a same angular range but in different radial positions within the same sector. Although described in terms of angular position for purposes of explanation, the distance of an object or part of an object from the center pivot point is irrelevant. A goal is to sense the average power accepted from within each segment.

Generally, in the example of FIG. 4, the regions having different shading can represent a distribution of various areas having different absorption rates, which may change over time as heating progresses. For example, chunks of meat in soup can have a different absorption rate as compared to chunks of vegetables and a shared broth, where the broth may have a background absorption rate. Initially, segments, such as between 300 and 310 degrees, may have regions 406 and 418 averaged together until differences in absorption become more apparent as heating progresses over time. As heating continues, the differences between regions 406 and 418 may reduce as temperature blending occurs during the heating process and power delivery differences are reduced.

Figure 5A:
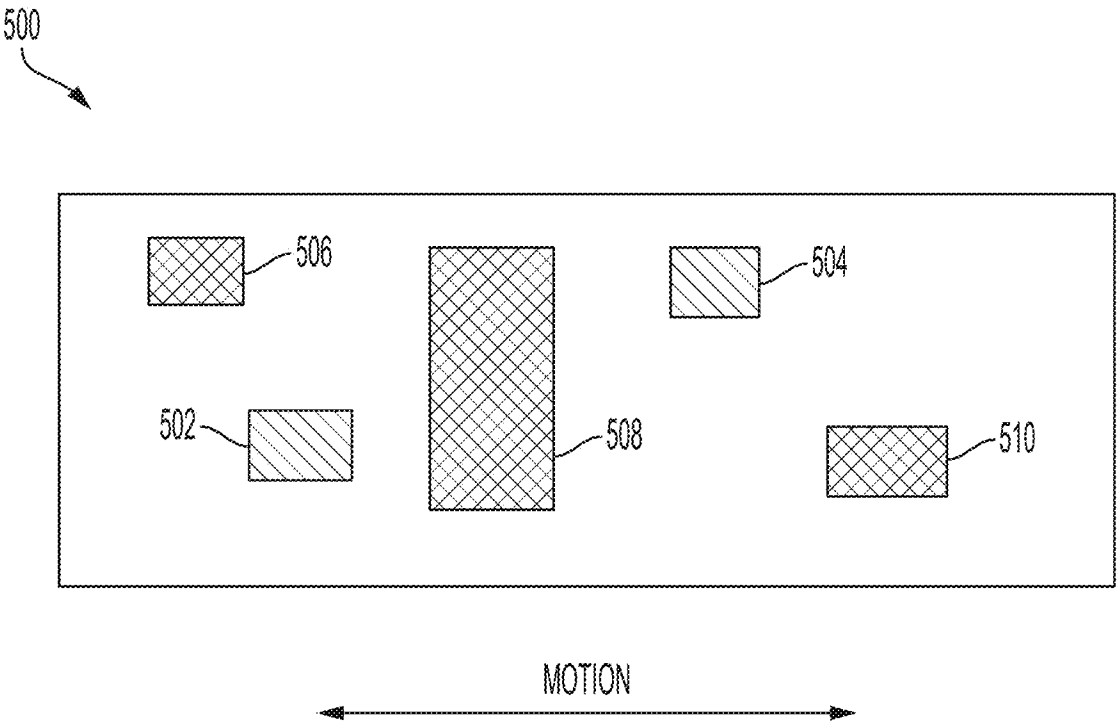
FIG. 5A depicts an exemplary heat map of an IMCS cooking session using a lateral movement platter according to some embodiments of the present invention.

FIG. 5A depicts an exemplary heat map 500 of an IMCS cooking session using a lateral movement platter according to some embodiments of the present invention. Where the platter 112 of FIG. 1 is a laterally moving platter, regions can be defined relative to x-y coordinates rather an angular or polar coordinates. For example, a region 502 that is above the first threshold can be located proximate to an opposite end of the platter 112 as compared to a region 504 that is above the first threshold. Further, the heat map 500 can also define regions 506, 508, 510 that are above the second threshold.

Figure 5B:
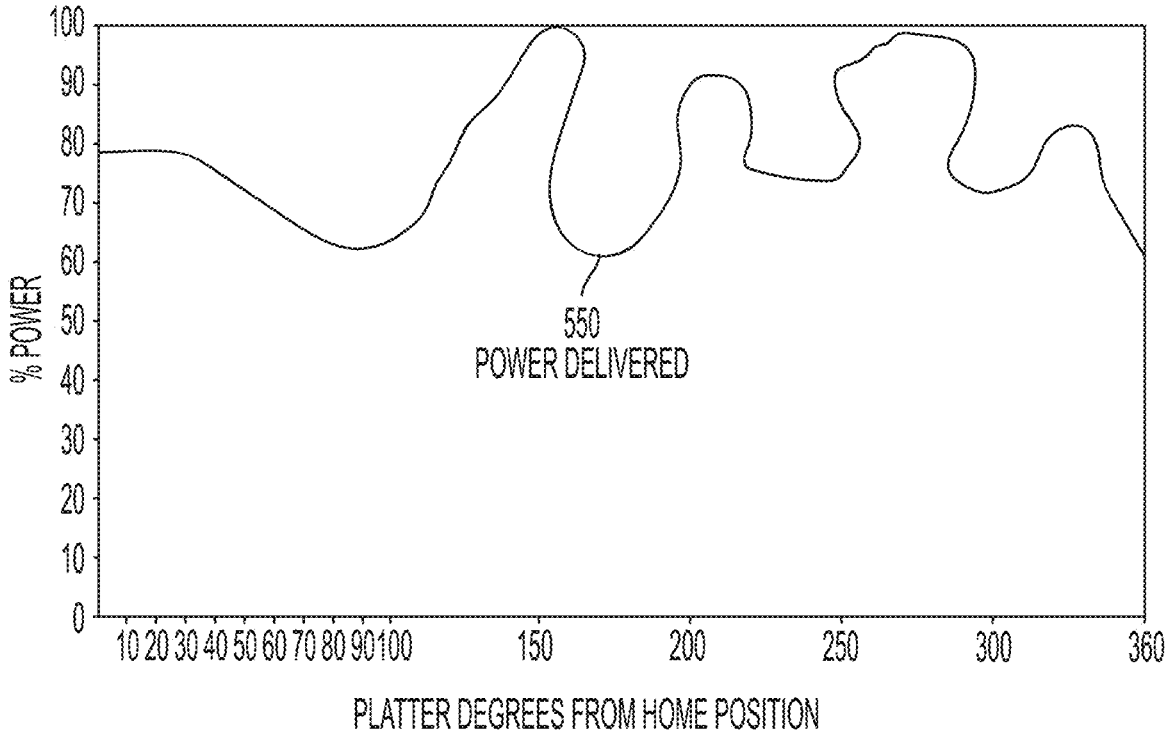
FIG. 5B depicts the representative data output of the "heat map" of FIG. 5A according to some embodiments of the present invention.

FIG. 5B depicts the representative data output of the heat map 500 of FIG. 5A according to some embodiments of the present invention. As shown in the plot 550 of this figure, for each excursion cycle the position of the platter traverses a course between the "home" index position (typically "0" degrees relative) and the return to the "home" position as represented by "0" or "360" degrees as noted on the "X" axis. As the platter is traversing its course the output power level is correspondingly being recorded on the "Y" axis. For any X/Y point on the graph, an appropriate preset action may be triggered such as any position that had accepted an output level of, for example, 50% or more power than other areas the following sweep cycle would take corrective action as has been already described such as speeding through those position(s). Regardless of whether a circular platter motion around a center point or a platter with linear motion is used, the same data gathering and corresponding corrective action(s) may be utilized.

Figure 6:
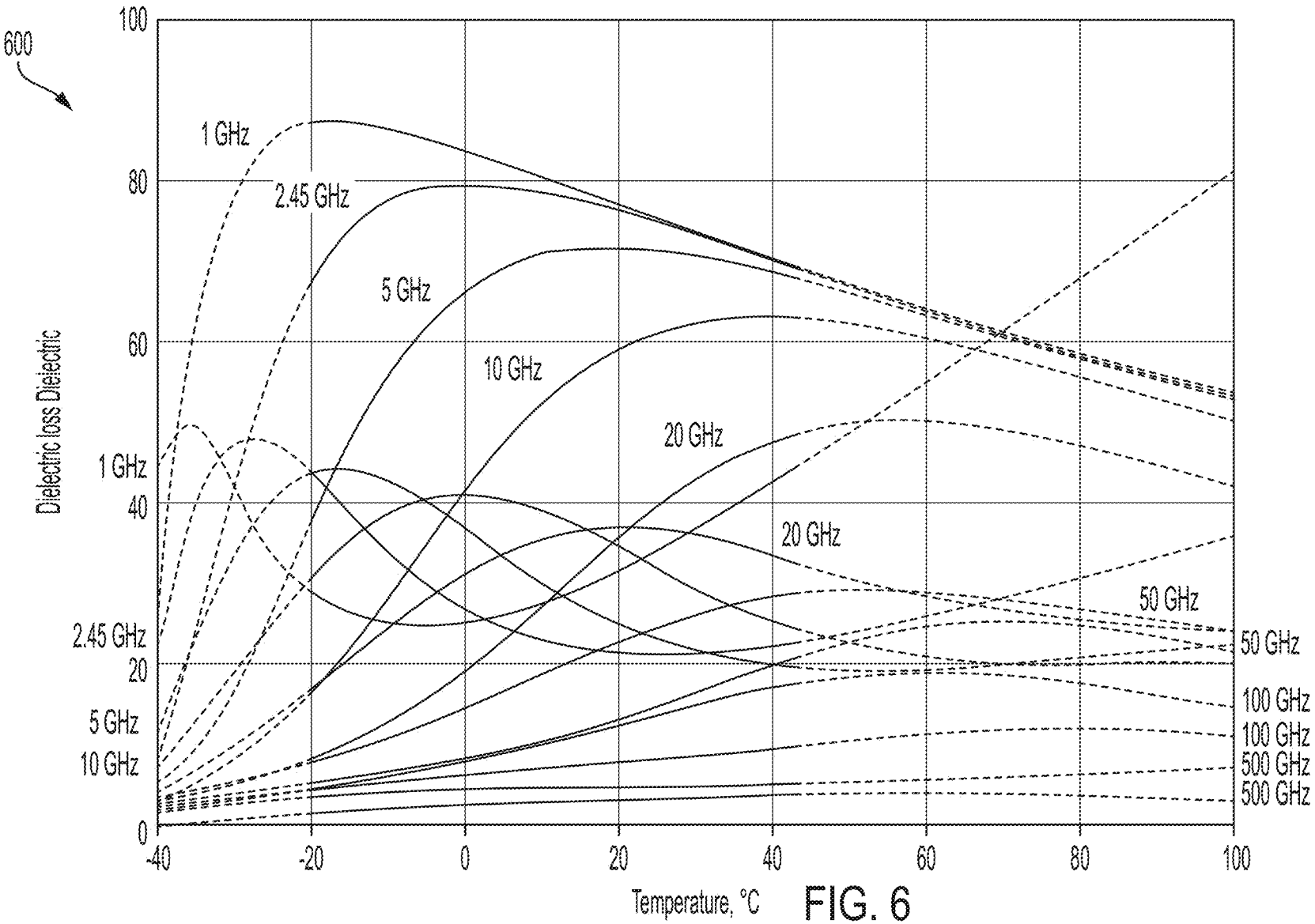
FIG. 6 depicts a dielectric loss graph of water at various frequencies and temperatures.

FIG. 6 depicts a dielectric loss graph 600 of water at various frequencies and temperatures. It is well known that water exists in various physical states, e.g., frozen, vapor, or liquid, with each state having different dielectric loss properties and characteristics. These differences are reflected in the monitored power acceptance ("dielectric loss") of water depending on which physical state the water is in. While non-intelligent microwave ovens 'blindly' deliver energy to an item in a random and non-reactive manner, the IMCS 110 essentially gets instructional "feedback" from the item itself that is being cooked/heated due to the instant level of energy being accepted by the target item.

As the oven contents cook, frozen water molecules within the item(s) begin to undergo a physical state transition, which increases the amount of power that is accepted into the item(s) from the RF-producing element. This is reflected in an increased mains input power consumption by the RF-producing element and/or a rise in the actual level of RF power being accepted by the cooking load.

Figure 7:
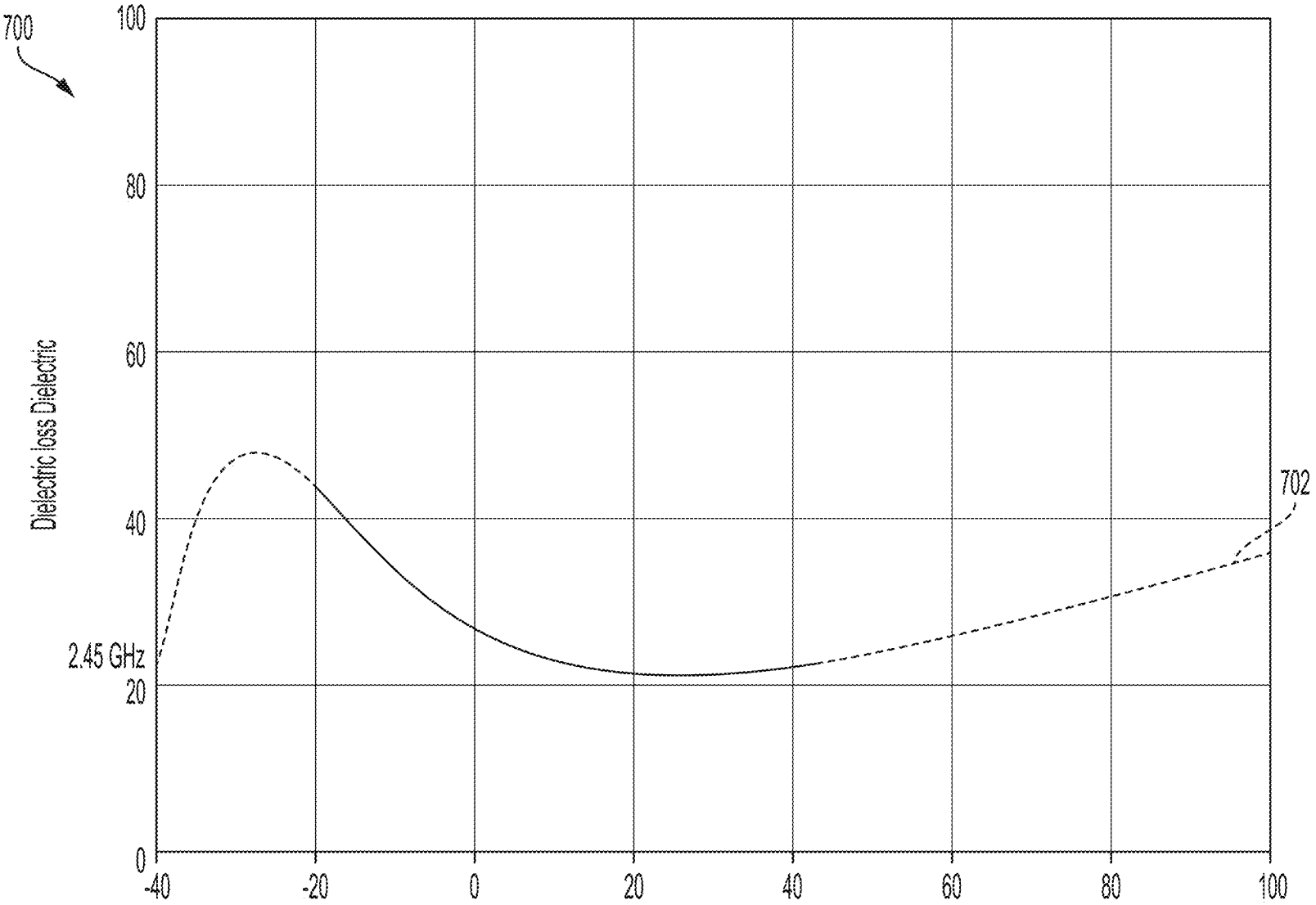
FIG. 7 depicts a dielectric loss graph of water at 2.45 GHz at various temperatures.

As one example in the microwave spectrum, as illustrated in a dielectric loss graph 700 of FIG. 7, at a nominal 2.4 GHz frequency of a microwave oven, frozen items that initially start cooking at a temperature of approximately −23.3° C. (−10° F.) can have a dielectric loss of approximately 50 decreasing to approximately 20 as the temperature rises to approximately 32.2° C. (90° F.) as depicted in plot 702. The dielectric loss can then gradually increase to approximately 35 at approximately the boiling point of water (100° C., 212° F.). By using an algorithm based on a known dielectric loss curve(s), the IMCS logic can track not only the overall energy absorption over known temperature/loss segments, but also factor in the diminishment of the overall water content of an item being cooked. Notably, the dielectric loss need not precisely follow a single curve, as there can be some variations, for instance, depending on a level of salt content, where the effects of salt become more substantial as temperature increases. Where a food type selection is made by a user, the IMCS can select a dielectric loss plot that is expected to more closely align to the food type, where such data can be collected experimentally or learned through machine learning and stored in the memory system 124 of FIG. 1.

Figure 8:
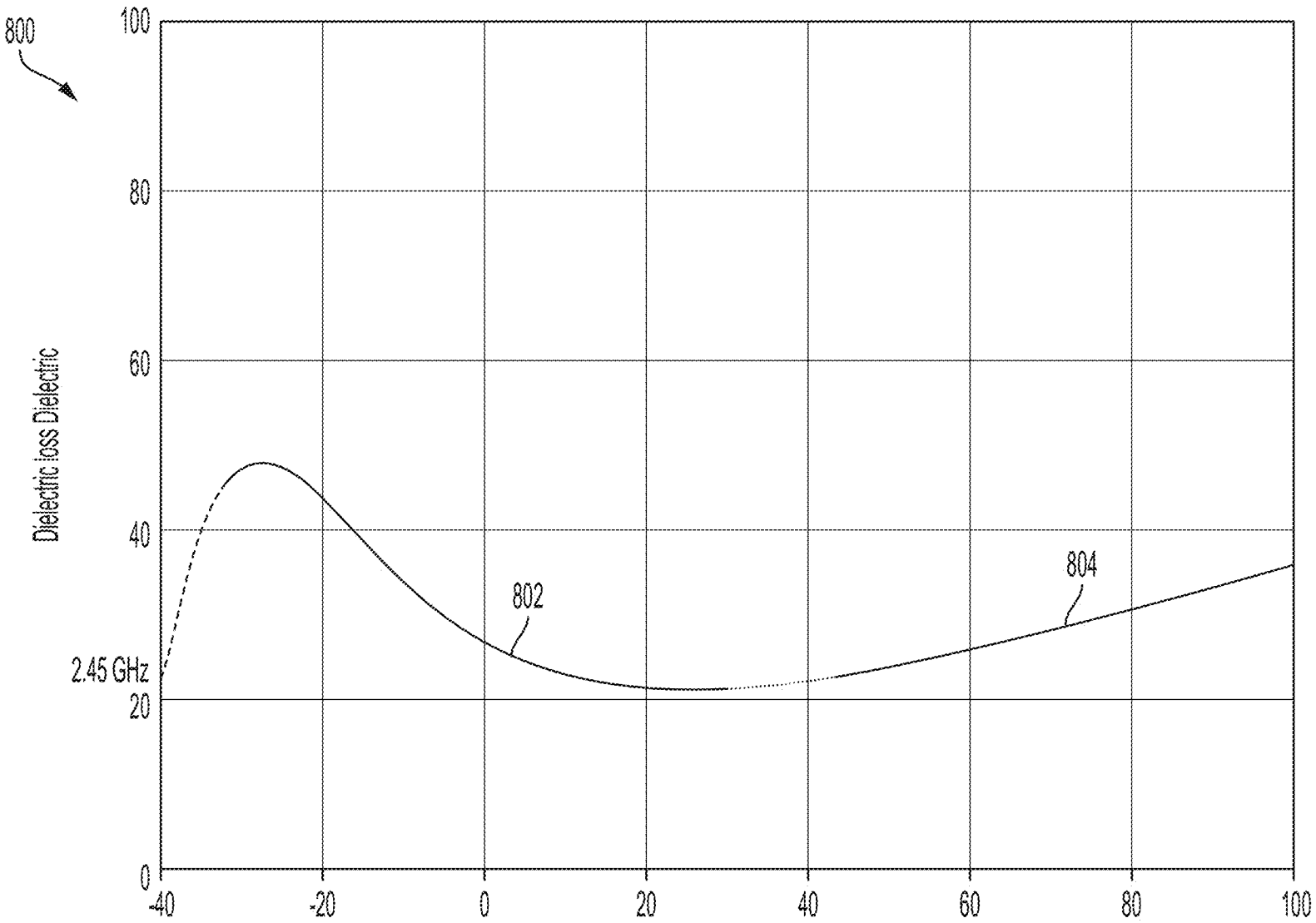
FIG. 8 depicts a dielectric loss graph of water at 2.45 GHz at various temperatures with exemplary IMCS logic pathway algorithms indicated for use with various temperatures according to some embodiments of the present invention.

As illustrated in FIG. 8, a dielectric loss graph 800 can include plot regions that differ based on whether the temperature of the item is in a frozen on unfrozen state. By a user selecting either a "Frozen" or "Unfrozen" initial item state using operating controls 111 of FIG. 1, that allows the IMCS logic to select the corresponding part of a dielectric loss curve for appropriate use, such as a lower region 802 of dielectric loss values associated with temperatures at or below the freeze point of water and an upper region 804 of dielectric loss values associated with temperatures above the freeze point of water. Further embodiments of IMCS ovens may include the use of a thermistor or other temperature sensing device (e.g., temperature sensor 132 of FIG. 1) to determine the pre-cooking temperature of a target item to automate the "Frozen" or "Unfrozen" logic selection. Note that the inclusion of a temperature sensor 132 within the microwave oven cavity 116 with this embodiment serves a very different purpose than prior attempts at trying to determine whether an item has reached a terminal cooking temperature. In this case, the temperature sensing is used to determine which dielectric loss curve segment for the IMCS logic to utilize.

Dielectric loss quantifies a dielectric material's inherent dissipation of electromagnetic energy (e.g. heat). It can be parameterized in terms of either the loss angle δ or the corresponding loss tangent (tan δ). Both refer to the phasor in the complex plane whose real and imaginary parts are the resistive (lossy) component of an electromagnetic field and its reactive (lossless) counterpart. In the context of microwave ovens, relative permittivity can be referred to as the "dielectric constant", and thus these terms may be used interchangeably. The actual value of the relative permittivity need not be directly measured. Rather, changes in the absorption/acceptance level of microwave energy of water being heated within the microwave oven can be monitored, especially when state changes occur, such as ice to water or water to steam.

An IMCS oven when used to control the cooking of homogenous or largely homogenous items that will not be undergoing a water state change such as non-frozen soups, heating water, etc. may not need to bother with sector comparisons and instead just rely on monitoring the overall rate of energy acceptance/dielectric loss which may serve as a proxy for the actual heated item temperature. The IMCS logic with knowledge of the dielectric loss curve may use the percentage rise of the curve as a desired temperature proxy when heating non-frozen liquids. If a user desires a liquid to reach a boiling temperature, the IMCS logic can follow the dielectric loss rise, and then terminate the heating process upon sensing an energy delivery plateau or diminishment as would be the case as the contained water begins to boil off. Unlike the previously noted indirect method of monitoring an increase in cavity humidity, even in this case the IMCS logic continues to rely on changes in delivered and accepted RF power.

Various embodiments of the IMCS may include an adjustable 'delta amount' sensitivity threshold difference between scans to determine the point at which an section/sector equalizing corrective action needs to be taken by the IMCS. A further embodiment may also include the monitoring of a delivered/accepted power level "rate of change" to determine the point at which a corrective action is taken by the IMCS. Yet another embodiment may include the use of "smart" food selection buttons which uniquely take into account the appropriate heating and water content diminishment profiles for various food items. The use of such food selector buttons can further enhance the automatic cooking process by refining one or more logic settings that would optimize, for example, the cooking of low moisture foods such as popcorn. In this example, changes with the delivered "power levels" can still be used but the power level change(s) would have different energy delta sensing characteristics than with other types of items.

User input guidance in the form of selecting from various item "profile" buttons or settings may also be used to fine-tune the IMCS logic's regulation. By a user using selection buttons such as one for popcorn, where an abrupt overall moisture change (and attendant power change) may occur, the IMCS logic can be sensitized to expect a rapid overall power drop when most or all of the kernels have popped and stop the cooking process appropriately to prevent the overcooking that typically occurs with microwaved popcorn.

The overall goal of IMCS is to contextually deliver power to parts of an item in order to evenly cook that item. If all cooked items were homogenous and/or round in shape and centered on the rotational axis, then items would evenly cook. Because, however, many items are typically held in rectangular platters that may be offset from the actual center of rotation, this means that present approaches often fail as they steadily and blindly deliver the same energy level at all times.

In some instances, food intended specifically for microwave cooking utilizes what is known as "susceptor" packaging that would also need to be automatically cooked. Susceptors create a secondary source of heat from within the packaging to aid with the browning, crisping, etc. of the food within the packaging. With conventional microwave ovens, the susceptor packaging warns the user NOT to use a "popcorn" setting of the oven. In some IMCS embodiments, however, a susceptor food type selection may be made to more ideally handle the automatic cooking of items in such packaging. Since the composition of susceptors is such that they are designed to purposefully absorb a disproportionate amount of microwave energy to a degree greater than the food that is contained within them or adjacent to them, this would appear to the IMCS logic as an unchanging outlying area of maximum microwave energy absorption. In a "susceptor" cooking mode, once the IMCS logic detected such a condition, the IMCS logic would then recognize the physical location of the susceptor and may concentrate the delivery of energy to that area so as to maximize the cooking action of the susceptor.

Figure 9:
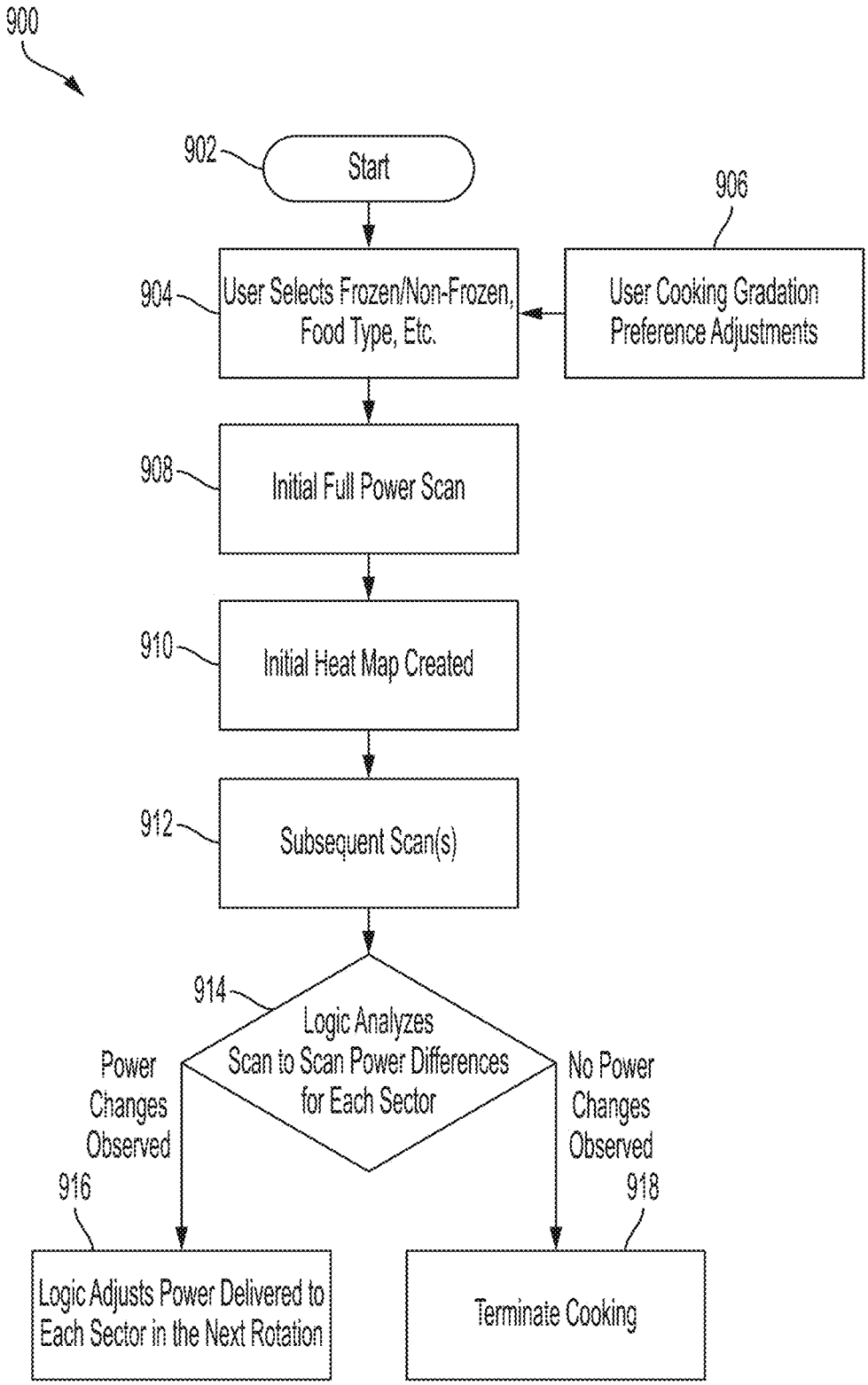
FIG. 9 depicts an IMCS logic schematic diagram according to some embodiments of the present invention.

FIG. 9 depicts an IMCS logic schematic diagram as a process 900 according to some embodiments of the present invention. Process 900 begins at block 902. At block 904, a user can select whether a food item is in a frozen state or a non-frozen state through the operating controls 111 and may also input other supporting information, such as a food type. Parameters for heating the food item can also be populated based on user cooking gradation preference adjustments of block 906, where the parameters are combined at block 904. At block 908, an initial full power rotational scan can be performed. The full power scan can operate the microwave energy source 118 at full power (e.g., power level 10 of 10) while controlling the actuation system 119 to rotate or shift the platter 112 through an uninterrupted full cycle of movement. Energy fluctuations can be observed based on a rotated/shifted position any food item on the surface as the positional indicator 113 moves with the platter 112 relative to the positional sensor 114. The data gathered during the initial sweep is used to initially create a heat map at block 910. At block 912, subsequent scans are performed as the food item continues to absorb microwave energy emitted by the microwave energy source 118, and actuation system 119 continues to rotate or shift the platter 112.

At block 914, the IMCS logic can analyze scan-to-scan power differences for each sector as observed over multiple cycles (e.g., complete rotations, sector scans, etc.) of the platter 112. While power changes are continued to be observed, the IMCS logic can subsequently adjust power delivered to each sector for a next rotation at block 916. Power delivery changes can include duty cycle changes to increase or reduce power output of the microwave energy source 118 based on a position of the platter 112 that places a targeted portion of a food item in a location expected to receive a greater or lesser exposure to the microwave energy emitted by the microwave energy source 118. Further, power delivery adjustment can change a rate of movement of the platter 112 and/or a direction of movement of the platter 112 as determined by the IMCS logic. At block 914, where no subsequent power changes are observed (or power changes are less than a completion threshold), cooking is terminated at block 918. Cooking termination can include de-energizing the microwave energy source 118, depowering the actuation system 119, and outputting a notification to the user, for instance, as a sound, flashing of the internal cavity lights, a message on the user display 136, and/or a message on another device (e.g., a mobile device) where the IMCS 110 supports external communication.

Figure 10A:
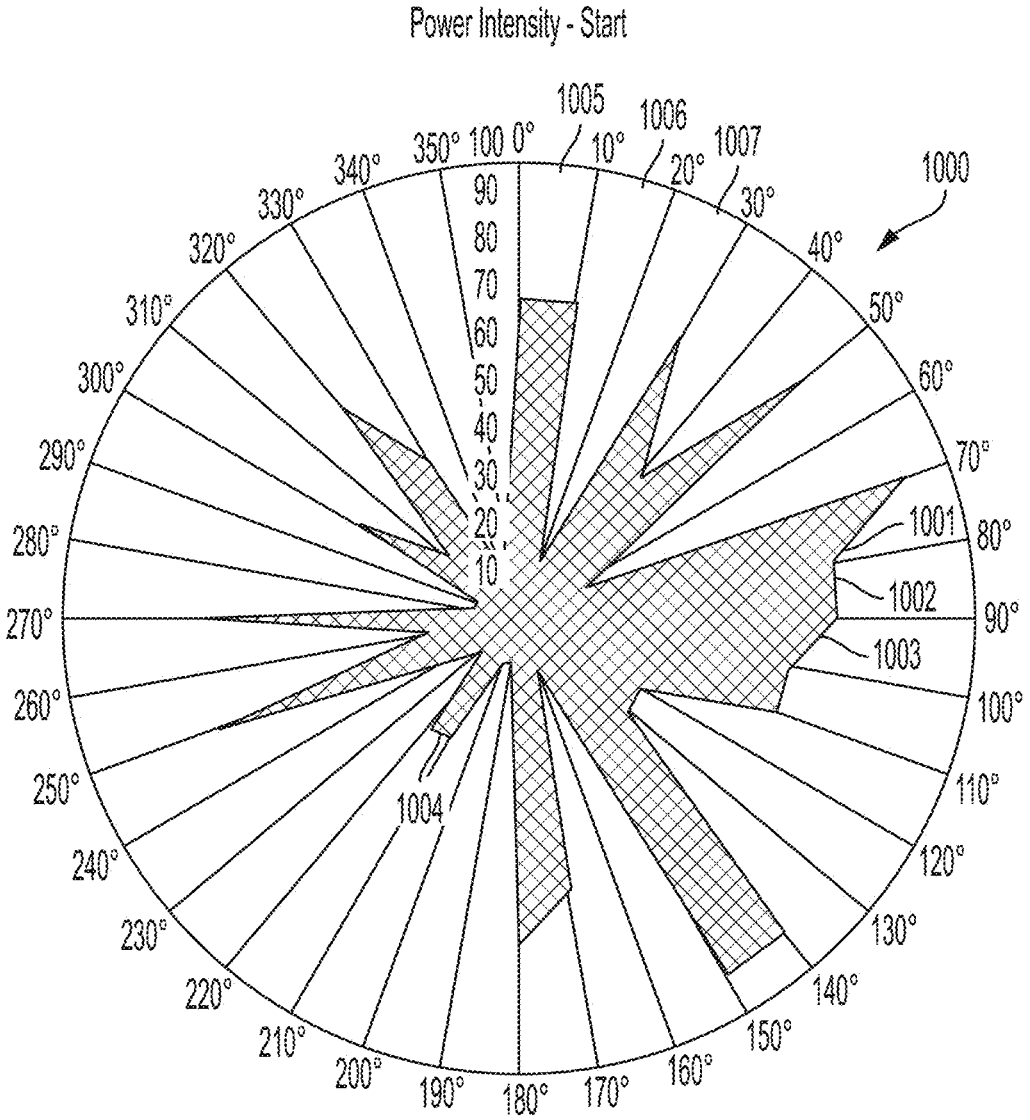
FIG. 10A depicts an exemplary heat map which can be presented to and analyzed by IMCS logic according to some embodiments of the present invention.

As a further example, FIG. 10A depicts a heat map 1000 that represents 36 segments per rotation, with each segment (1005, 1006, 1007, etc.) including a 10 degree "slice" or portion of a complete 360-degree rotation of a rotating platter as platter 112. Each segment shown represents the averaged recorded power level(s) (1001, 1002, 1003, 1004, etc.) that was actually delivered to each angular segment in the previous rotation. In this example, segment 1005 accepted 70% of the output power, while segment 1006 did not accept any power. Power levels 1001, 1002, 1003, and 1004 represent the power accepted at different angular positions, where the power can vary within each segment. The power accepted by each segment (1005, 1006, 1007, etc.) is forwarded to the IMCS logic for processing. Power acceptance can be indirectly or directly determined in several ways. Essentially, the IMCS while cooking or heating contents continually follows the amount of Radio Frequency (RF) power that was accepted by the microwave cavity's contents relative to a positional context of a cooking platter 112. As previously described, the cooking platter 112 has a "home" position index 113 from which during a cooking cycle it traverses a defined excursion course and returns to the home position 113. Regardless of how many of these excursions are made, the relationship between the platter position and the instant amount of energy that was accepted by each segment needs to be measured. There are several ways of determining the amount of accepted RF energy. The first method is to monitor the amount of input energy that is drawn by the magnetron or other RF generation device at its supplied power input. Although the IMCS may determine the amount of output energy that is accepted by the cavity contents, in this example the IMCS can determine relative output measurements (e.g., the relative amount of power accepted among various segments or sectors), without the need to determine empirical power readings. In this context, by measuring the input power (typically in watts) that is drawn by the magnetron this results in an acceptable proxy for measuring the RF output power since there is a more or less fixed mains electrical power to RF power efficiency. Alternately, the RF output level of the magnetron may be directly measured, either by monitoring the "forward" power level, the reverse power level, or both simultaneously which results in a Standing Wave Ratio (SWR) indication.

Figure 10B:
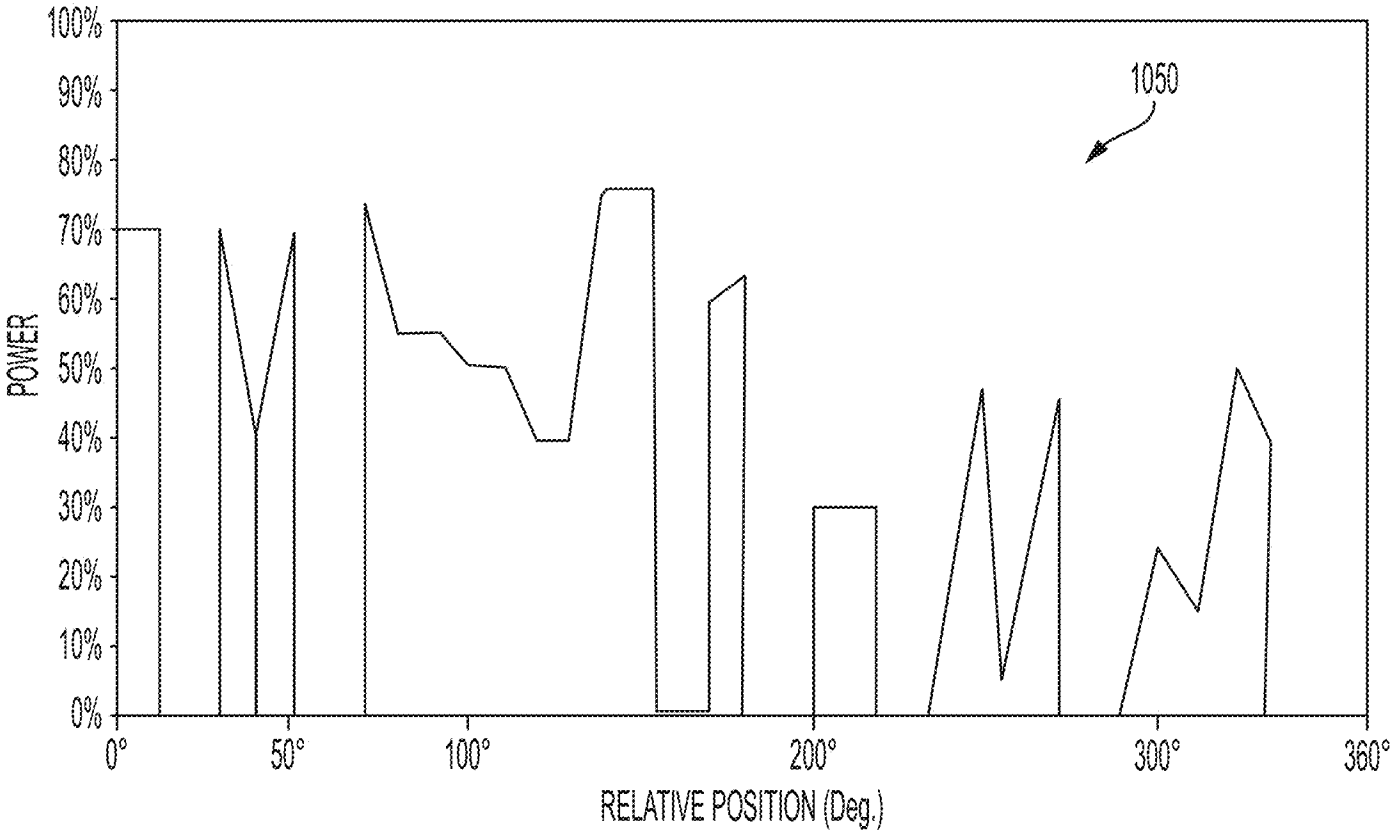
FIG. 10B depicts the representative data output of the "heat map" shown in FIG. 10A according to some embodiments of the present invention.

FIG. 10B depicts the representative data output of the heat map 1000 shown in FIG. 10A according to some embodiments of the present invention. As shown in the plot 1050 of FIG. 10B, The percentage of power intensity can change with respect to relative position of the platter as defined in degrees. For instance, some relative position ranges may experience little to no power acceptance, while other position ranges can have higher and varying levels of power acceptance. The plot 1050 changes over time and the heat map 1000 changes during the heating process.

Figure 11:
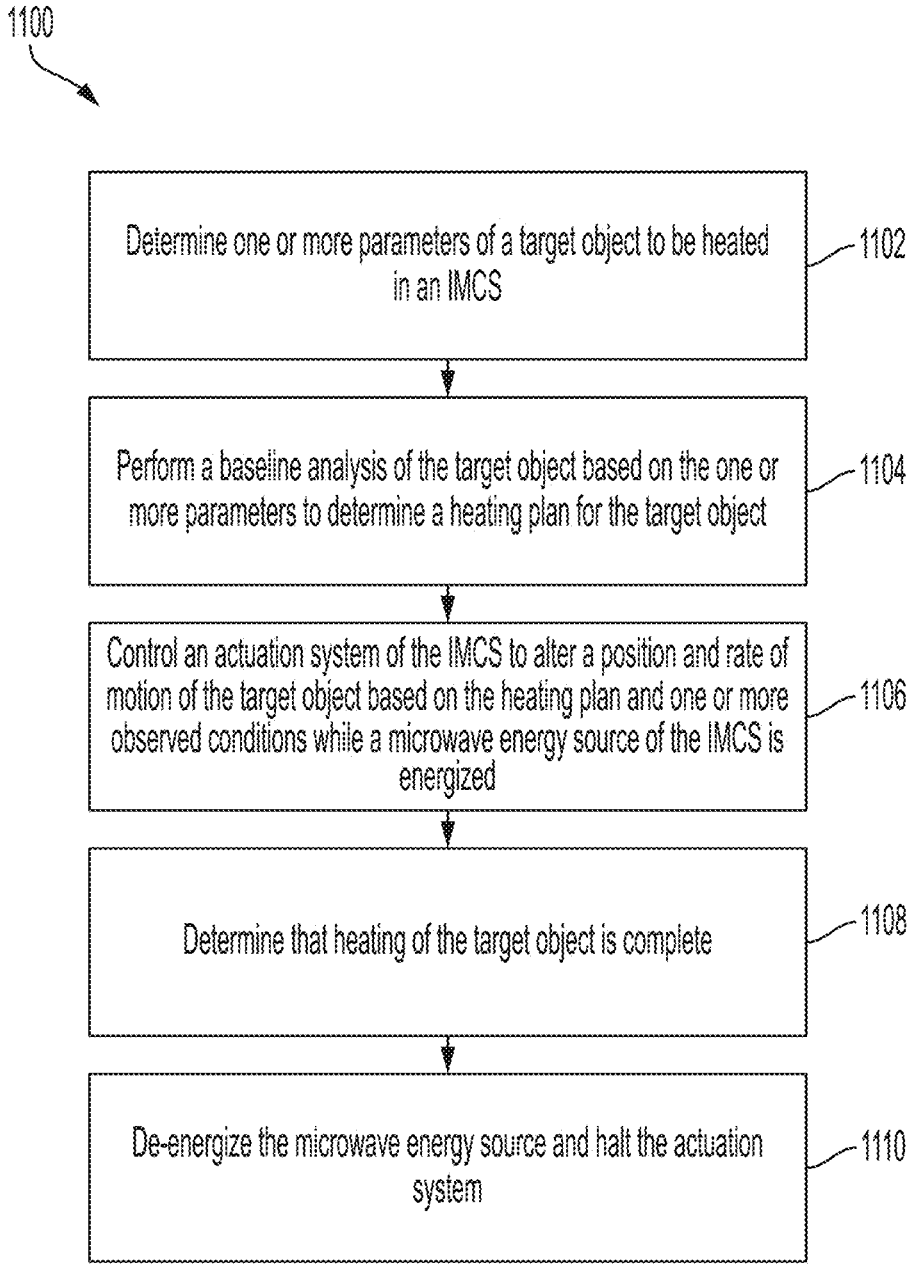
FIG. 11 depicts a heating process according to some embodiments of the present invention.

FIG. 11 depicts a process 1100 of heating a target object according to some embodiments of the present invention. The process 1100 can be performed by the IMCS 110 of FIG. 1. Although steps of the process 1100 are depicted in a particular order, it will be understood that steps can be added, omitted, further subdivided, combined, or performed in a different order than is depicted in FIG. 11.

At block 1102, IMCS logic of the IMCS 110 can determine one or more parameters of a target object to be heated in the microwave oven cavity 116 of the IMCS 110. The one or more parameters can be determined based on input received through a user interface 134 of operating controls 111 of the IMCS 110. The one or more parameters can specify a frozen state or a non-frozen state of the target object. The one or more parameters can also specify a cooking level preference, such as a "warm" temperature or a "hot" temperature, where associated temperature ranges can be configurable (e.g., 40 degrees to 60 degrees C. vs. 60 degrees to 80 degrees C., etc.).

At block 1104, IMCS logic of the IMCS 110 can perform a baseline analysis of the target object based on the one or more parameters to determine a heating plan for the target object. The baseline analysis can include energizing the microwave energy source 118, controlling the actuation system 119 to move the platter 112 through a cycle of motion, and observing an energy parameter associated with the microwave energy source 118. The baseline analysis can produce a heat map and/or corresponding data map of the target object based on the energy parameter observed through the cycle of motion. The heating plan can include one or more segments where an increase or reduction of energy delivery is desired to homogenize a temperature profile of the target object. One or more aspects of the heating plan can differ between the frozen state and the non-frozen state of the target object. For example, a power level output of the microwave energy source 118 can be operated at a reduced duty cycle level while the target item remains in the frozen state. The heating plan can be a "defrost only" plan, a "defrost and cook" plan, a "reheat" plan, a "cook" plan, and other such variations that set different desired termination conditions. Where a defrost and cook plan is to be performed, the IMCS logic can monitor the dielectric loss or other such value to project when the target item has likely transitioned from a frozen state to a non-frozen state and further project likely internal temperatures observed at various regions of the target item with further targeted heating performed until a termination condition is met.

At block 1106, IMCS logic of the IMCS 110 can control the actuation system 119 to alter a position and rate of motion of the platter 112 based on the heating plan and one or more observed conditions while the microwave energy source 118 is energized. The motion control of block 1106 is performed during heating of the target object and differs from the stirring control that can be performed while the microwave energy source 118 is de-energized, as further described with respect to FIGS. 12 and 13. Control of the actuation system 119 can include one or more of: speeding up movement of the platter 112, slowing down movement of the platter 112, and/or alternating the position of the platter 112 in a rocking pattern for the one or more segments. The heat map can be dynamically adjusted based on a detected change to the energy parameter as the target object is heated. The one or more observed conditions can be determined by monitoring one or more of: energy accepted by the target object, input energy, and/or a temperature within the microwave oven cavity 116.

At block 1108, IMCS logic of the IMCS 110 can determine that heating of the target object is complete. Heating of the target object can be determined to be complete based on detecting a scan by scan change in the overall energy absorption by the target object below a configurable completion threshold. Further, heating of the target object can be determined to be complete based on monitoring a dielectric loss parameter associated with the energy absorption by the target object and reaching a target value of the dielectric loss parameter associated with a terminal temperature.

Figure 12:
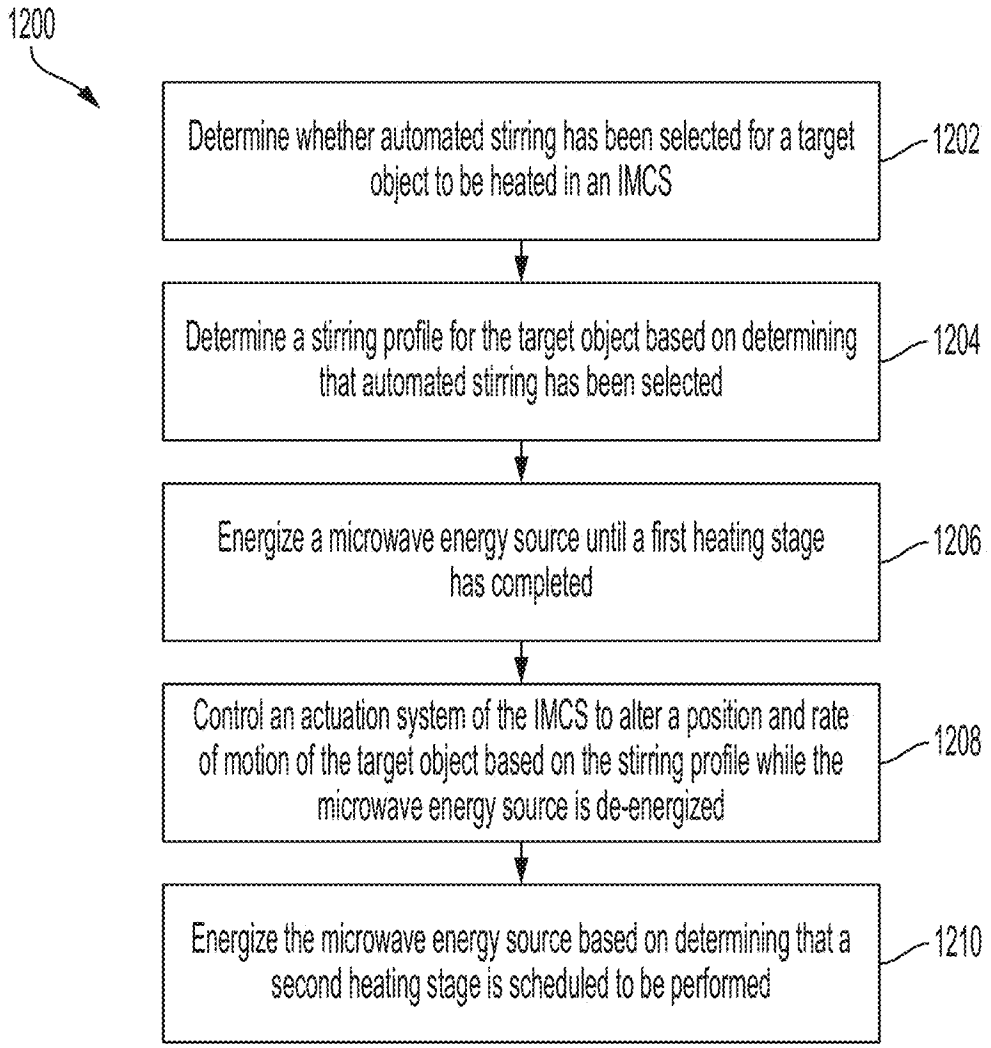
FIG. 12 depicts an automated stirring process according to some embodiments of the present invention.

At block 1110, IMCS logic of the IMCS 110 can de-energize the microwave energy source 118 and halt the actuation system 119. In some embodiments, upon determining that heating of the target object is complete, the actuation system 119 may continue to move the platter 112 until the positional indicator 113 aligns with the positional sensor 114 at a home position before halting the actuation system 119 such that the platter 112 starts in an aligned position for the initial scan upon the next use of the IMCS 110. In other embodiments the IMCS 110 after terminating the active heating/cooking cycle may activate an aggressive period of movement to mix the contents residing on the IMCS platter 112 to further equalize areas or contents of the cooked/heated item. FIG. 12 depicts a process 1200 of automated stirring within a cooking cycle according to some embodiments of the present invention. The process 1200 can be performed by the IMCS 110 of FIG. 1. Although steps of the process 1200 are depicted in a particular order, it will be understood that steps can be added, omitted, further subdivided, combined, or performed in a different order than is depicted in FIG. 12. Further, process 1200 can be performed in combination with other processes, such as processes 200, 300, 900, and 1100 of FIGS. 2, 3, 9, and 11.

At block 1202, the controller 120 of the IMCS 110 can determine whether automated stirring within an overall cooking process has been selected for a target object to be heated in a microwave oven cavity 116 of the IMCS 110. Selection of automated stirring can be made through the user interface 134. Further, automated stirring can be incorporated as part of a food type selection and need not be separately selected.

At block 1204, the controller 120 can determine a stirring profile for the target object based on determining that automated stirring has been selected. The stirring profile can define features such as when as well as how often within the overall cooking process stirring should be performed, how rapidly the actuation system 119 should accelerate and/or change direction of rotation/movement of the platter 112, start/stop position targets to rotate/shift the platter 112 between targeted inflection points, an aggressiveness parameter that scales between slower change rates and faster change rates, a total stirring time, and/or other such parameters. The determinations can be made prior to heating the target object and/or may be made/adjusted during heating of the target object. Further, the stirring profile can be determined or adjusted after completing at least one heating stage.

At block 1206, the controller 120 can energize the microwave energy source 118 of the IMCS 110 until a first heating stage has completed. The operation of the IMCS 110 during the first heating stage may be performed according to one or more of the processes previously described. For example, the first heating stage may be defined in terms of power absorption or phase change determination rather than a time-based threshold.

At block 1208, the controller 120 can control the actuation system 119 of the IMCS 110 to alter a position and rate of motion of the target object on the platter 112 based on the stirring profile while the microwave energy source 118 is de-energized. Thus, after the first heating stage has completed and the microwave energy source 118 is de-energized, the automated stirring of contents of the target object can be performed to further blend areas that have different power absorption without requiring the user to intervene and manually stir the contents. The one or more gripping members 140 on the platter 112 can retain the target object relative to the platter 112 to reduce the risk of shifting/tipping over of the target object while the platter 112 is moved.

At block 1210, the controller 120 can energize the microwave energy source 118 based on determining that a second heating stage is scheduled to be performed. For example, where only a single heating stage is used, the automated stirring may be performed at the end of the heating cycle. Where the automated stirring is desired during the heating process, the heating process can be partitioned into two or more heating stages. As such, the automated stirring may occur between the first heating stage and the second heating stage. After completing a second or subsequent heating stages, the IMCS 110 can continue to control the actuation system 119 to alter the position and rate of motion of the target object based on the stirring profile while the microwave energy source 118 is de-energized after the second heating stage and/or subsequent heating stages are performed. Further, additional automated stirring may be performed after the second heating stage as either a final stirring or in preparation for another (e.g., a third) heating stage. Where multiple stirring steps are performed as part of a full heating cycle, the stirring profile of each stirring step can be different. For instance, a first stirring cycle may be performed between a defrost stage and a cooking stage, and a second stirring cycle can be performed part way through the cooking stage. The rate of motion of each stirring cycle can be set based on an aggressiveness setting of the stirring profile. For example, the rate of stirring may be more aggressive where the target object is deemed to be not fully defrosted and more aggressive (e.g., higher rate change) movements are desired to move a relatively lower amount of liquid state material around as compared to a fully defrosted state.

Figure 13:
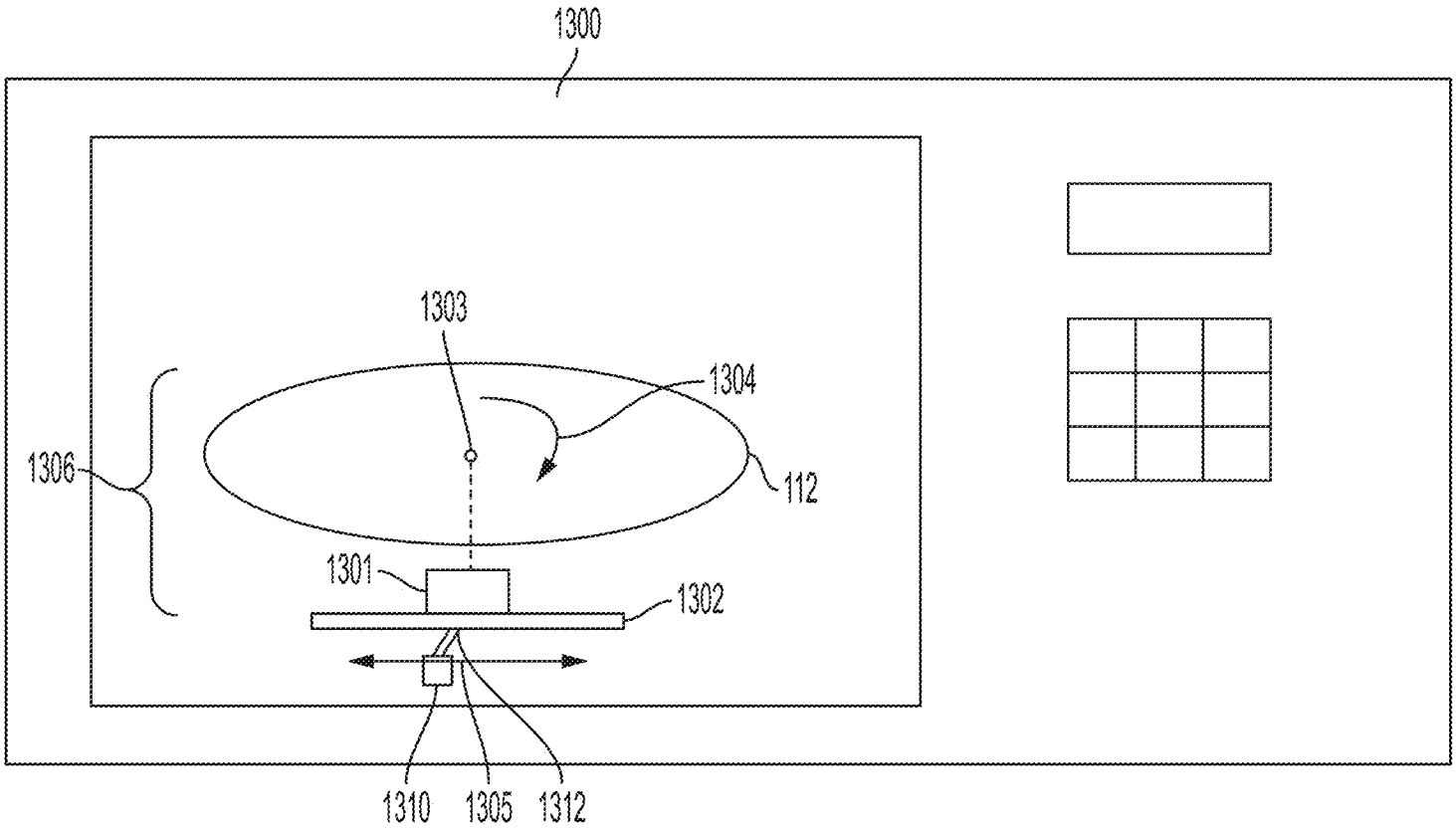
FIG. 13 depicts a stirring system of an IMCS according to some embodiments of the present invention.

FIG. 13 depicts one embodiment of automated stirring system 1300 of an IMCS, such as IMCS 110 of FIG. 1. Platter 112, which is operatively connected to a platter motor 1301 (e.g., actuation system 119 of FIG. 1) at a center of platter location 1303 can provide a circular motion 1304 to the platter 112 as part of a circular rotation assembly 1306. The circular rotation assembly 1306 can be mounted to a motion platform 1302 which is operatively connected to a second motor 1310 and a linkage 1312 which further provides the circular rotation assembly 1306 an ability for eccentric motion 1305. For example, the second motor 1310 and linkage 1312 can shift a position of the circular rotation assembly 1306 while the platter motor 1301 drives the circular motion 1304 to the platter 112. This combination of movement options can support a large variety of stirring profiles while performing the process 1200 of FIG. 12.

While microwave oven turntables historically are connected to motors that rotate at the center of a circular platter, in the present disclosure the platter 112 rotation motor (e.g., platter motor 1301) instead of being affixed to a stationary mounting assembly can be further mounted to an eccentric motion mounting assembly which provides an eccentric and/or an elliptical movement of the circular rotation assembly 1306. The motion platform 1302 and second motor 1310 can introduce a varying and uneven centripetal force on the circular rotation assembly 1306, which can cause the circular rotation assembly 1306 to repeatedly shift into various physical locations via lateral movements.

During a "mixing" (stirring) operation the platter motor 1301 can optionally stop while the motion platform 1302 and second motor 1310 perform a multi-directional "shaking", which can result in a rapid "back and forth" movement of the platter 112 and its direct mounting assembly. Essentially there can be a movable platter assembly mounted upon a second movable assembly. The intent of the second movable assembly is to quickly alter the position of the first assembly wherein the rapid change of position due to inertia would subject the platter 112 (and its held contents) to strong and changing "G" forces which would cause the contents of objects affixed upon the platter 112 to effectively mix or homogenize the various constituted parts of the object in order to mimic a physical stirring of the contents albeit without having to slit container coverings, remove containers from the IMCS, peal back any covering, utilize flatware to manually stir the contents within a container, recover a container, return the container to the platter 112, and manually resume the cooking operation. Depending on the speed and/or power of the eccentric rotating motor assembly, various levels of "stirring" intensity may be achieved.

In summary, embodiments include a system for intelligently determining the duration of microwave oven cooking, where a target object inside an intelligent microwave cooking system effectively self-instructs the oven as to the degree and timing of specific areas within said object being heated or cooked. Embodiments can include a system where an intelligent microwave cooking system autonomously and dynamically self-determines the optimum cooking time and power levels used to optimally cook and/or heat a target object. The intelligent microwave cooking system can measure one or more accepted energy values of the target object. The accepted energy values can be derived by monitoring the input energy of the microwave producing device associated with the intelligent microwave cooking system. The accepted energy values can be derived by measuring the actual forward RF output power delivered to the oven cavity. The accepted energy values can be derived by measuring the actual reverse RF output power delivered to the oven cavity. The accepted energy values can be derived by measuring the actual Standing Wave Ratio (SWR) of the RF output power delivered to the oven cavity.

In some embodiments, an intelligent microwave cooking system creates an initial scan of the target object in which to create a "heat map" representing the areas and initial amount of accepted energy with the target object. The scan can be of a rotating turntable or a laterally moving platter. The intelligent microwave cooking system can be configured to separately alter the energy delivered based on prior energy delivered scan(s) which indicate the location of differing energy acceptance areas within the target object. The intelligent microwave cooking system can be configured to self-determine the point of terminating a cooking cycle. The intelligent microwave cooking system can be configured to self-determine the point of terminating a heating cycle.

According to an embodiment, a system for intelligently altering the rotational or lateral movement speed of the turntable or platter can be operated in a dynamic bi-directional manner and may completely halt the rotation or movement in order to deliver additional concentrated energy to a specific spot or area during the cooking cycle.

According to an embodiment, an intelligent microwave cooking system can allow different algorithms to be dynamically determined and utilized by the oven itself based on the characteristics of the target objects.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), a universal serial bus (USB) drive, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wire line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++, Python, or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a computer or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowcharts and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In general, the invention may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. The terms "first," "second," and the like, herein do not denote any order, quantity, or importance, but rather are used to denote one element from another. The term "exemplary" indicates an example. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system comprising:

a microwave energy source;

a microwave oven cavity; and a controller configured to:

determine one or more parameters of a target object to be heated in the microwave oven cavity;

perform a baseline analysis of the target object based on the one or more parameters to determine a heating plan for the target object;

monitor changes to electric input power drawn by the microwave energy source while the microwave energy source is energized; and determine that heating of the target object is complete based on the monitored changes in an amount of the electric input power drawn by the microwave energy source.

2. The system of claim 1, wherein the one or more parameters are determined based on input received through a user interface of operating controls of the system.

3. The system of claim 2, wherein the one or more parameters specify a frozen state or a non-frozen state of the target object.

4. The system of claim 3, wherein one or more aspects of the heating plan differ between the frozen state and the non-frozen state of the target object.

5. The system of claim 3, wherein the one or more parameters specify a cooking level preference.

6. The system of claim 1, further comprising:

an actuation system configured to move a platter within the microwave oven cavity, wherein the controller is configured to control the actuation system to alter a position and rate of motion of the platter based on the heating plan and one or more observed conditions while the microwave energy source is energized, and the baseline analysis comprises energizing the microwave energy source, controlling the actuation system to move the platter through a cycle of motion, and observing an energy parameter associated with the microwave energy source.

7. The system of claim 6, wherein the baseline analysis produces a heat map of the target object based on the energy parameter observed through the cycle of motion, and the heating plan comprises determining one or more segments where an increase or reduction of energy delivery is desired to homogenize a temperature profile of the target object.

8. The system of claim 7, wherein control of the actuation system comprises one or more of: speeding up movement of the platter, slowing down movement of the platter, and/or alternating the position of the platter in a rocking pattern for the one or more segments.

9. The system of claim 7, wherein the heat map is adjusted based on a detected change to the energy parameter as the target object is heated.

10. The system of claim 1, wherein one or more observed conditions are determined by monitoring one or more of: energy accepted by the target object and/or a temperature within the microwave oven cavity.

11. A system comprising:

a microwave energy source;

a microwave oven cavity;

an actuation system configured to move a platter within the microwave oven cavity; and a controller configured to:

determine one or more parameters of a target object to be heated in the microwave oven cavity;

perform a baseline analysis of the target object based on the one or more parameters to determine a heating plan for the target object;

control the actuation system to alter a position and rate of motion of the platter based on the heating plan and one or more observed conditions while the microwave energy source is energized; and determine that heating of the target object is complete, wherein heating of the target object is determined to be complete based on detecting a change in energy absorption by the target object below a configurable completion threshold.

12. A system comprising:

a microwave energy source;

a microwave oven cavity;

an actuation system configured to move a platter within the microwave oven cavity; and a controller configured to:

determine one or more parameters of a target object to be heated in the microwave oven cavity;

perform a baseline analysis of the target object based on the one or more parameters to determine a heating plan for the target object;

control the actuation system to alter a position and rate of motion of the platter based on the heating plan and one or more observed conditions while the microwave energy source is energized; and determine that heating of the target object is complete, wherein heating of the target object is determined to be complete based on monitoring a dielectric loss parameter associated with the energy absorption by the target object and reaching a target value of the dielectric loss parameter associated with a terminal temperature.

13. A method comprising:

determining, by a controller, one or more parameters of a target object to be heated in a microwave oven cavity;

performing, by the controller, a baseline analysis of the target object based on the one or more parameters to determine a heating plan for the target object;

monitoring, by the controller, changes to electric input power drawn by a microwave energy source while the microwave energy source is energized; and determining, by the controller, that heating of the target object is complete based on the monitored changes in an amount of the electric input power drawn by the microwave energy source.

14. The method of claim 13, wherein the one or more parameters specify a frozen state or a non-frozen state of the target object, and one or more aspects of the heating plan differ between the frozen state and the non-frozen state of the target object.

15. The method of claim 13, further comprising:

controlling, by the controller, an actuation system to alter a position and rate of motion of a platter in the microwave oven cavity based on the heating plan and one or more observed conditions, wherein the baseline analysis comprises energizing the microwave energy source, controlling the actuation system to move the platter through a cycle of motion, and observing an energy parameter associated with the microwave energy source.

16. The method of claim 15, wherein the baseline analysis produces a heat map of the target object based on the energy parameter observed through the cycle of motion, and the heating plan comprises determining one or more segments where an increase or reduction of energy delivery is desired to homogenize a temperature profile of the target object.

17. The method of claim 16, wherein control of the actuation system comprises one or more of: speeding up movement of the platter, slowing down movement of the platter, and/or alternating the position of the platter in a rocking pattern for the one or more segments.

18. The method of claim 16, wherein the heat map is adjusted based on a detected change to the energy parameter as the target object is heated.

19. The method of claim 13, wherein one or more observed conditions are determined by monitoring one or more of: energy accepted by the target object and/or a temperature within the microwave oven cavity.

20. The method of claim 13, wherein heating of the target object is determined to be complete based on detecting a change in energy absorption by the target object below a configurable completion threshold.

* * * * *